US011595747B2

(12) United States Patent
Su

(10) Patent No.: US 11,595,747 B2
(45) Date of Patent: Feb. 28, 2023

(54) HEADSET WITH MEMBRANE COUPLING CONNECTING THE HEADBAND TO THE EARPIECES

(71) Applicant: Logitech Europe S.A., Lausanne (CH)

(72) Inventor: Hsueh Jang Su, Pleasanton, CA (US)

(73) Assignee: Logitech Europe S.A., Lausanne (CH)

( * ) Notice: Subject to any disclaimer, the term of this patent is extended or adjusted under 35 U.S.C. 154(b) by 8 days.

(21) Appl. No.: 17/246,386

(22) Filed: Apr. 30, 2021

(65) Prior Publication Data

US 2022/0353603 A1 Nov. 3, 2022

(51) Int. Cl.
*H04R 1/10* (2006.01)

(52) U.S. Cl.
CPC ..... *H04R 1/1066* (2013.01); *H04R 1/1008* (2013.01)

(58) Field of Classification Search
CPC ..... H04R 1/1066; H04R 1/1008
See application file for complete search history.

(56) References Cited

U.S. PATENT DOCUMENTS 3,833,939 A * 9/1974 Dostourian ..... H04R 1/1066 2/209
7,171,698 B2 * 2/2007 Saffran ..... A61F 11/14 2/209
8,098,873 B2 1/2012 Furuya et al.
8,213,667 B2 * 7/2012 Nelson ..... F16C 11/06 381/370
9,084,055 B2 * 7/2015 Brunner ..... H04R 1/1075
10,667,029 B2 * 5/2020 Cochran ..... H04R 1/1066
11,006,206 B2 * 5/2021 Morris ..... H04R 1/1008
2003/0210801 A1 * 11/2003 Naksen ..... H04R 1/1066 381/376
2004/0216946 A1 * 11/2004 Lenhard-Backhaus ..... H04R 1/1066 181/129
2011/0051976 A1 * 3/2011 Tsai ..... H04R 1/1066 381/378
2012/0269374 A1 * 10/2012 Lee ..... H04R 1/1008 381/379
2014/0133688 A1 * 5/2014 Brodsgaard ..... H04R 1/105 381/379
2015/0131809 A1 * 5/2015 Jones ..... H03G 5/165 381/74

(Continued)

*Primary Examiner* — Oyesola C Ojo
(74) *Attorney, Agent, or Firm* — Kilpatrick Townsend & Stockton LLP

(57) ABSTRACT

A headset includes an earpiece coupled to a headband with a membrane coupling. The earpiece includes an outer housing and an audio driver positioned within and coupled to the outer housing. The membrane coupling includes a membrane insert composed of a resilient material. The membrane insert is coupled to the outer housing. A connection pin may extend through a central opening of the membrane insert and into an end of the headband in order to directly couple the end of the headband to the membrane insert in order to couple the outer housing to the end of the headband. The coupling of the end of the headband to the outer housing with the membrane insert in between defines the membrane coupling. The membrane coupling is designed to allow relative movement in six degrees of freedom comprising three orthogonal degrees of translation freedom and three orthogonal degrees of rotational freedom.

20 Claims, 16 Drawing Sheets

(56) References Cited

U.S. PATENT DOCUMENTS

| | | | | |
|---|---|---|---|---|
| 2015/0289047 | A1* | 10/2015 | Greig | H04R 1/105<br>381/74 |
| 2016/0277822 | A1* | 9/2016 | Blair | H04R 1/105 |

* cited by examiner

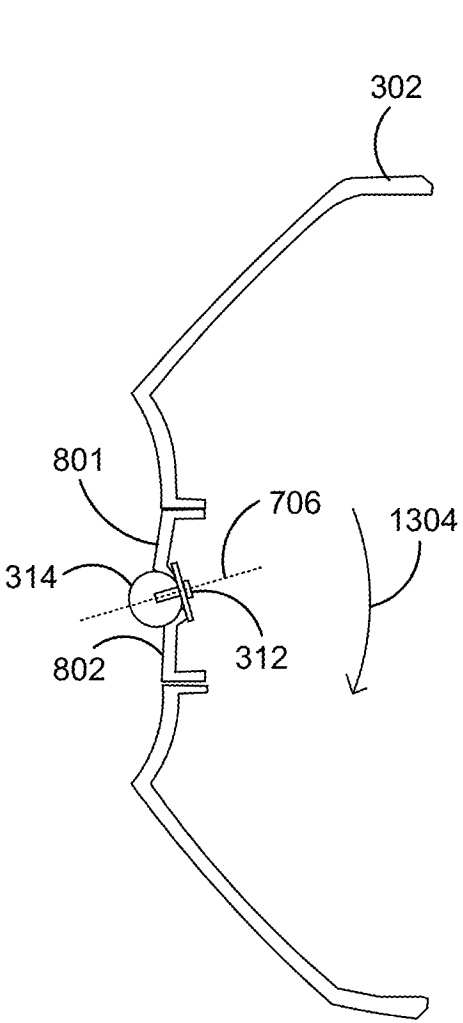
FIG. 13C
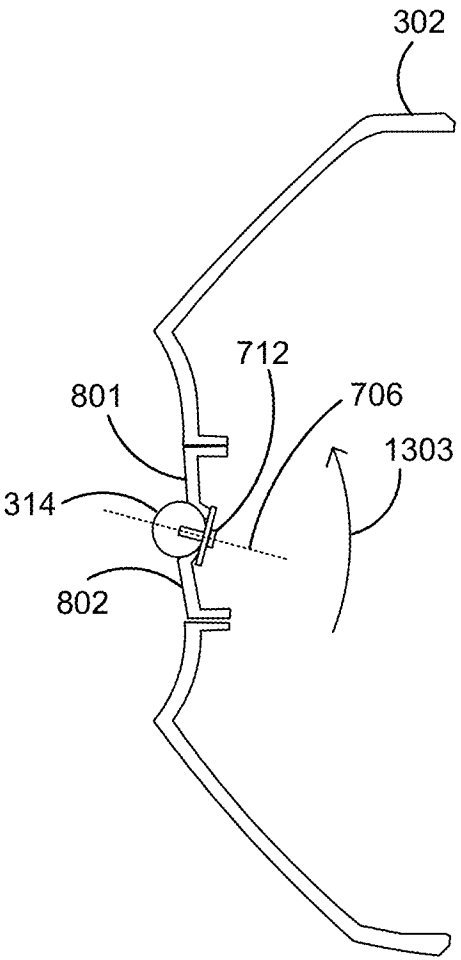
FIG. 13B
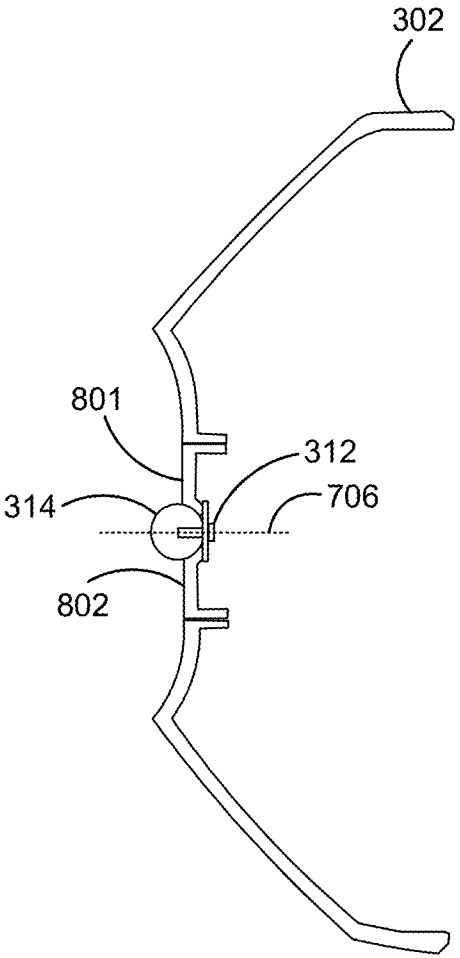
FIG. 13A
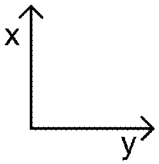

HEADSET WITH MEMBRANE COUPLING CONNECTING THE HEADBAND TO THE EARPIECES

BACKGROUND

The present technology relates to headsets, and in particular to headsets including adjustability between the headband and the earpieces.

Over the head audio headsets include a headband coupled to earpieces. The headsets are worn by users to provide immersive listening experiences by providing isolation from ambient noises in the surrounding environment due to the headband providing a clamping force to hold the earpieces, containing audio drivers, against the user's head thus covering the user's ears. Over the head headsets are popular for listening to content, for example, music, movies, podcasts and conference calls, and offer the user privacy from others in the same space. Often a user may desire to listen to the content for extended periods of time, e.g. more than an hour. Due to the extended periods of use a user may become uncomfortable by the clamping force holding the earpieces to the user's head. Accordingly, there is a need to reduce the clamping force and/or reduce the perceived clamping force while maintaining the earpieces being held against the user's head.

BRIEF SUMMARY

A headset may include an earpiece coupled to a headband with a membrane coupling. The earpiece may include an outer housing and an audio driver positioned within and coupled to the outer housing. The membrane coupling may include a membrane insert composed of a resilient material. The membrane insert may include a central portion and a flange around a perimeter of the central portion. The central portion of the membrane insert may define a central opening. The flange may be coupled to the outer housing. The headband may be designed to be placed over a head of a user and exert a clamping force on the head of the user. A connection pin may extend through the central opening of the membrane insert and into an end of the headband in order to directly couple the end of the headband to the membrane insert in order to couple the outer housing to the end of the headband. The coupling of the end of the headband to the outer housing with the membrane insert in between may define the membrane coupling. The membrane coupling may be designed to allow relative movement in six degrees of freedom comprising three orthogonal degrees of translation freedom and three orthogonal degrees of rotational freedom.

In some embodiments, the resilient material forming the membrane insert may be thermoplastic polyurethane. In some embodiments, the outer housing defines an opening, and the membrane insert is positioned within the opening so that the flange of the membrane insert is coupled to a flange of the outer housing around the opening. In some embodiments, the membrane insert is formed within the opening of the outer housing in a dual injection process. In some embodiments, the membrane insert is coupled within the opening with adhesive between the flange of the membrane insert and the flange of the outer housing.

In some embodiments, the membrane insert and the opening are circular. In some embodiments, the membrane insert and the opening are oblong. In some embodiments, the membrane insert and the opening are rectangular.

In some embodiments, due to the resilient material the membrane coupling produces a restoring force in response to relative movement in at least one of the six degrees of freedom between the outer housing and the end of the headband. The relative movement may be from a first position to a second position, and the restoring force may bias the relative movement back toward the first position. In some embodiments, the membrane coupling may be designed to produce different magnitudes of restoring force in response to a same magnitude of translation for each of the three orthogonal degrees of translational freedom. The different magnitudes of restoring force may be a result of the membrane insert being designed to have different thicknesses or hardness of different portions of the central portion. In some embodiments, the membrane coupling is designed to produce different magnitudes of restoring force in response to a same magnitude of rotation for each of the three orthogonal degrees of rotational freedom. The different magnitudes of restoring force may be a result of the membrane insert being designed to have different thicknesses or hardness of different portions of the central portion.

In some embodiments, the membrane coupling is designed to define different ranges of motion each of the three orthogonal degrees of translational freedom. The different ranges of motion may result from the central opening location being designed to be at non-uniform distances from each point of the perimeter of the central portion. In some embodiments, the membrane coupling is designed to define different ranges of motion each of the three orthogonal degrees of rotational freedom. The different ranges of motion may result from the central opening being located at non-uniform distances from each point of the perimeter of the central portion.

In some embodiments, the connection pin is a screw, and a portion of the central portion around the opening is clamped between an end of the screw and the end of the headband. In some embodiments, the end of the headband is a ball coupled within a socket, and the screw extends into and is directly coupled to the ball. In some embodiments, the end of the headband is a cylindrical screw boss, and the screw extends into and is directly coupled to the screw boss.

In some embodiments, the headset also includes a second earpiece. The second earpiece may be substantially identical to the other earpiece and includes a second outer housing and a second audio driver positioned within and coupled to the second outer housing. The second earpiece may be coupled to the headband with a second membrane insert also composed of a resilient material. The second membrane insert may be substantially identical to the membrane insert and include a second central portion and a second flange around a perimeter of the second central portion, wherein the second central portion defines a second central opening and wherein the second flange is coupled to the second outer housing. A second connection pin may extend through the second central opening of the second membrane insert and into a second end of the headband, opposite the end of the headband, directly coupling the second end of the headband to the second membrane insert in order to couple the second outer housing to the second end of the headband. The coupling of the second end of the headband to the second outer housing with the second membrane insert in between may define the second membrane coupling configured to allow relative movement in six degrees of freedom comprising three orthogonal degrees of translation freedom and three orthogonal degrees of rotational freedom.

In some embodiments, the technology is directed to a membrane insert that may define a portion of a membrane coupling. The membrane insert is composed of a resilient material. The membrane insert may include a central portion and a flange around a perimeter of the central portion. The central portion of the membrane insert may define a central opening. The flange may be coupled to an outer body. The central portion may be coupled to an inner body. For example, a connection pin may extend through the central opening of the membrane insert and into the inner body to directly couple the inner body to the outer body. The membrane insert of the membrane coupling may be designed to allow relative movement in six degrees of freedom comprising three orthogonal degrees of translation freedom and three orthogonal degrees of rotational freedom.

BRIEF DESCRIPTION OF THE DRAWINGS

The features of the various embodiments described above, as well as other features and advantages of certain embodiments of the present invention will be more apparent from the following detailed description taken in conjunction with the accompanying drawings, in which:

FIGS. 13A-13C show rotation around a Z-axis of an earpiece relative to a membrane insert, according to embodiments of the present technology.

Throughout the drawings, it should be noted that like reference numbers are typically used to depict the same or similar elements, features, and structures.

DETAILED DESCRIPTION

Aspects of the present disclosure relate generally to headsets. In the following description, various examples of headsets including membrane couplings adjustably coupling the headband to the earpieces are described. For purposes of explanation, specific configurations and details are set forth in order to provide a thorough understanding of the embodiments. However, it will be apparent to one skilled in the art that certain embodiments may be practiced or implemented without every detail disclosed. Furthermore, well-known features may be omitted or simplified in order to prevent any obfuscation of the novel features described herein.

The following high-level summary is intended to provide a basic understanding of some of the novel innovations depicted in the Figures and presented in the corresponding descriptions provided below.

Figure 1A:
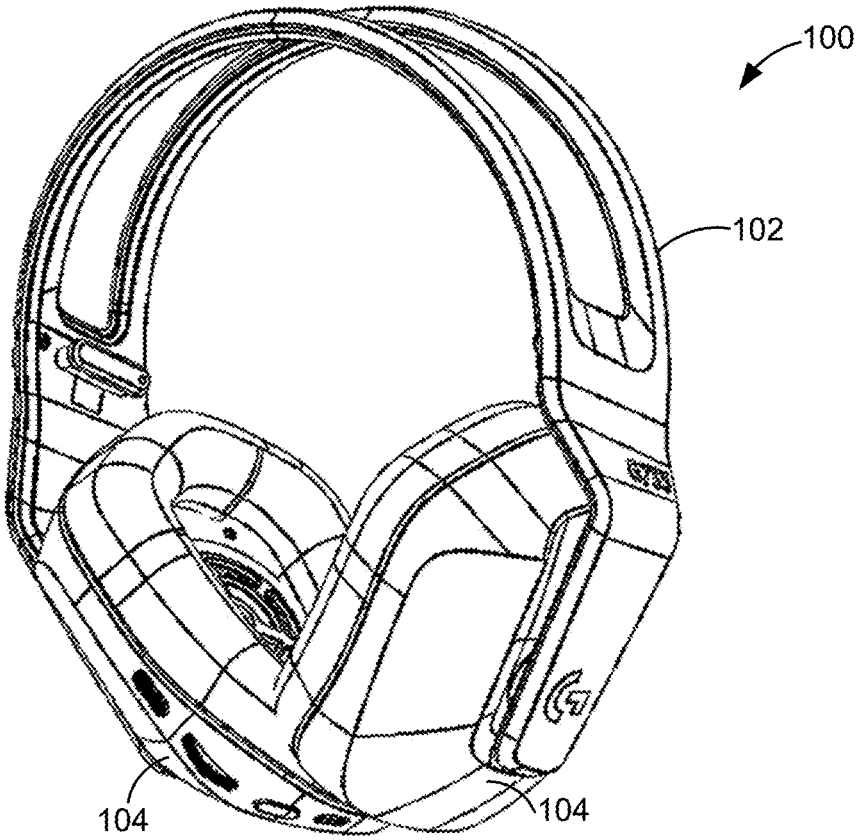
FIGS. 1A and 1B show a headset, according to embodiments of the present technology.
Figure 1B:
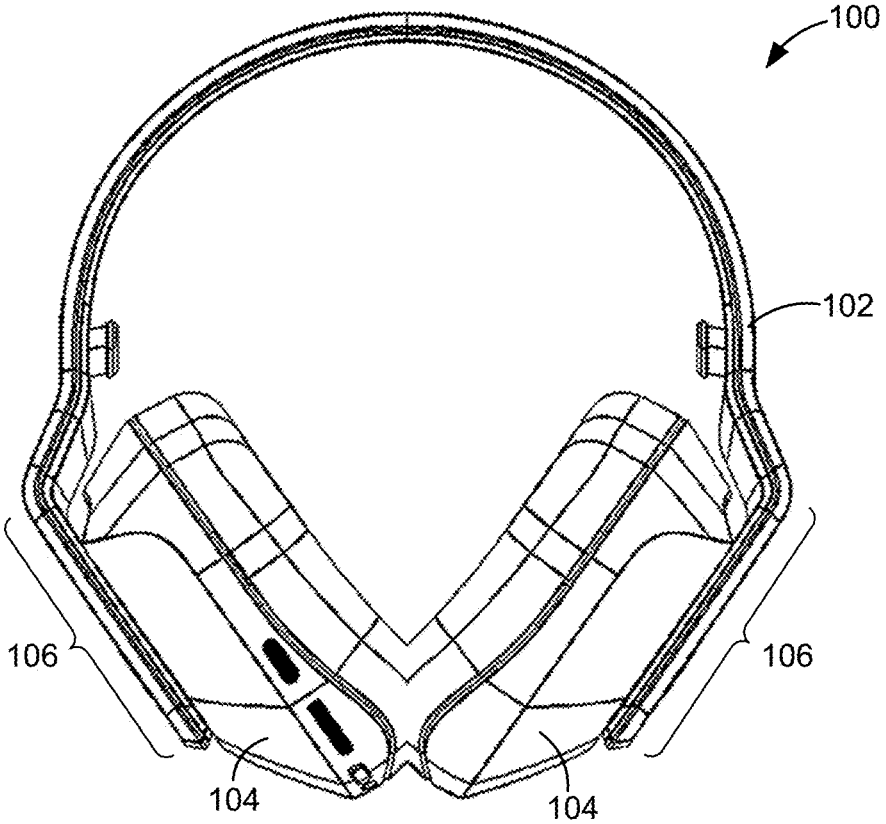
Figure 3A:
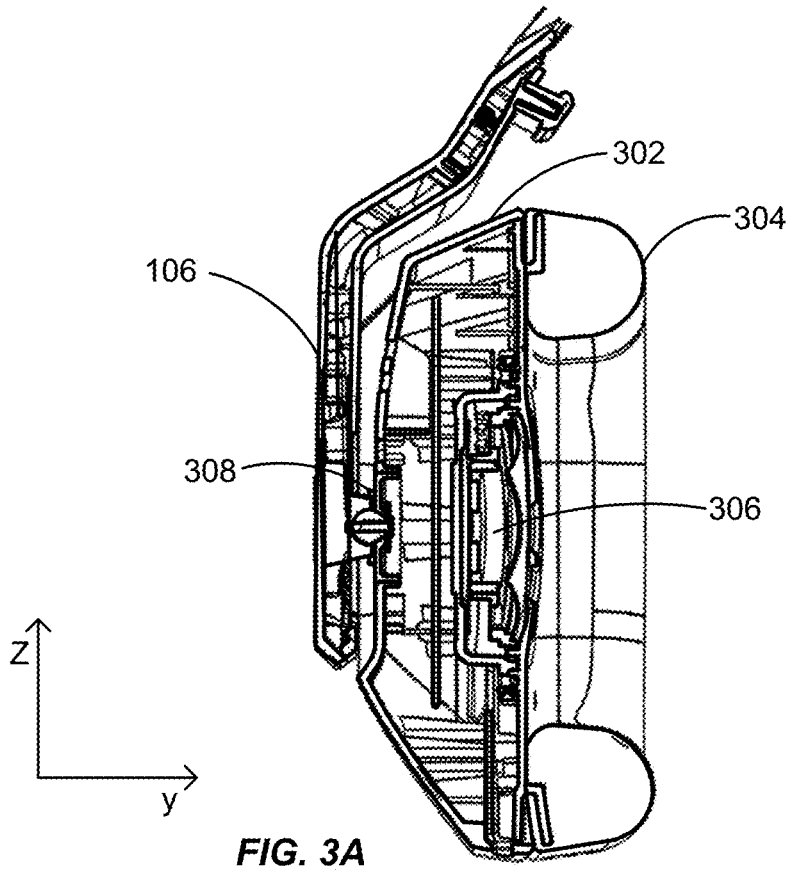
FIGS. 3A and 3B show cross-sectional views of a portion of a headset including an earpiece coupled to an end of a headband with a membrane coupling, according to embodiments of the present technology.
Figure 3B:
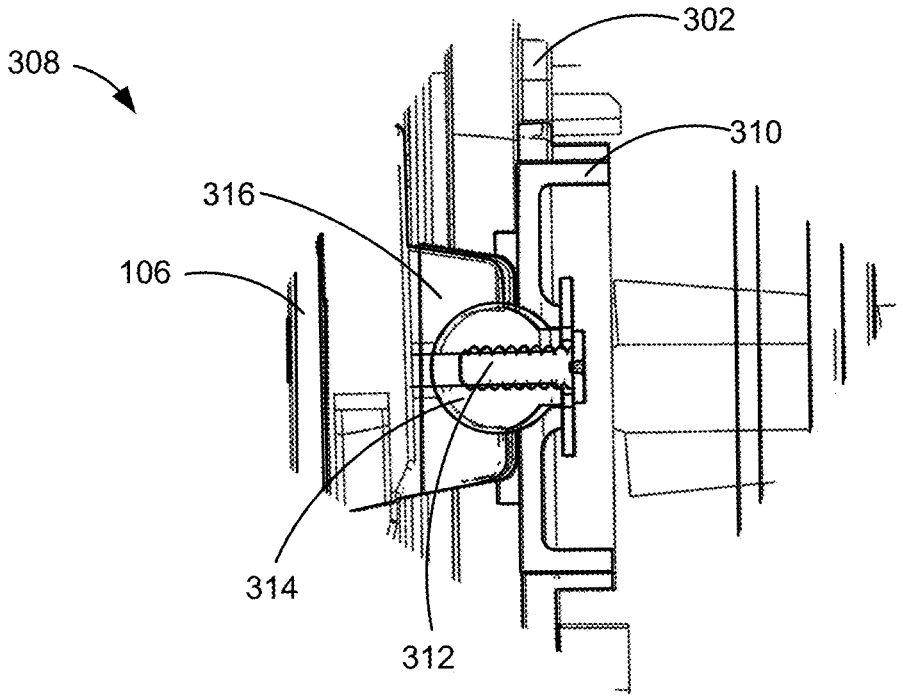

Generally, aspects of the technology are directed to membrane couplings 308 which may be used for connecting components of headsets 100, for example as shown in FIGS. 1A and 1B. The headsets include a headband 102 coupled to one or more earpieces 104 with the membrane coupling 308, as shown in FIGS. 3A and 3B. While the membrane coupling is shown as connecting two components of a headset, the membrane coupling may be used to connect any two bodies, i.e. a first body and a second body. The membrane coupling includes a resilient membrane insert coupled between a first body, in the case of a headset the earpiece, and a second body, in the case of a headset the headband, which allows for relative movement between the first body, in this case the earpiece, and the second body, in this case the headband, in six degrees of freedom comprising three orthogonal degrees of translation freedom and three orthogonal degrees of rotational freedom. The relative freedom in the six degrees of freedom is continuous and does not rely on user input. In use with a headset, the relative freedom in the six degrees of the membrane coupling allows for a reduction in the clamping force and/or a reduction in the perceived clamping force created by the headband while maintaining the earpieces being held evenly against the user's head.

FIGS. 1A and 1B show a headset 100 according to embodiments of the present technology. As shown, a headset 100 includes a headband 102 and two earpieces 104. The two earpieces 104 may be referred to as a first earpiece and a second earpiece, or a left earpiece and a right earpiece. In embodiments, a headset 100 may only include one earpiece, 102 and include a head contact pad at an end of the headband 102 opposite the one earpiece.

The headband 102 may be arch shaped and the earpieces 104 may be coupled to ends 106 of the arced headband 102. The headband 102 may be formed of materials and shaped in order to produce a spring forcing causing the ends 106 to be biased toward each other. As shown in FIGS. 1A and 1B with no outside force acting upon the ends 106 to pull the ends 106 apart the spring force of the headband 102 causes the earpieces 104 to contact one another. To place the headset 100 on a user's head the ends 106 and/or earpieces 104 are pulled apart so that the user's head may be positioned between the earpieces 104 and the earpieces 104 may be positioned over the user's ears. The spring force of the headband 102 will result in a clamping force holding the earpieces 104 against the user's head over the user's ears.

As shown in the figures, a headset 100 may include over the ear earpieces, however in embodiments the earpieces may be on the ear type earpieces, accordingly, as used herein the term earpiece may refer to over the ear, on the ear, or any other type of earpiece of a headset.

In embodiments, the one or more earpieces 104 of a headset are coupled to the ends 106 of the headband with a membrane coupling 308 in order to allow relative movement in up to six degrees of freedom, including three orthogonal directions of translational freedom and three orthogonal directions of rotational freedom. As used herein, the three orthogonal directions of translation and rotation may be referred to as X, Y, and Z.

Figure 2A:
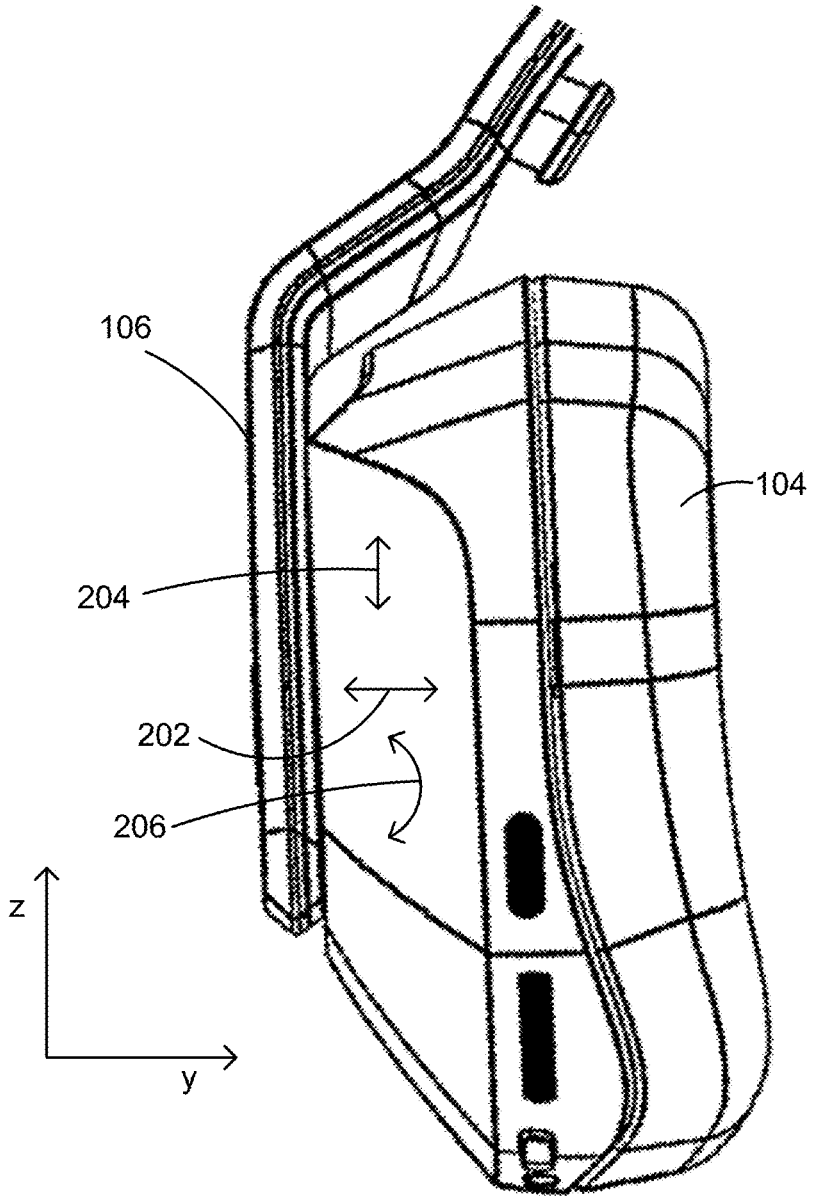
FIGS. 2A-2C show views of a portion of a headset including an earpiece and an end of a headband, according to embodiments of the present technology.
Figure 2B:
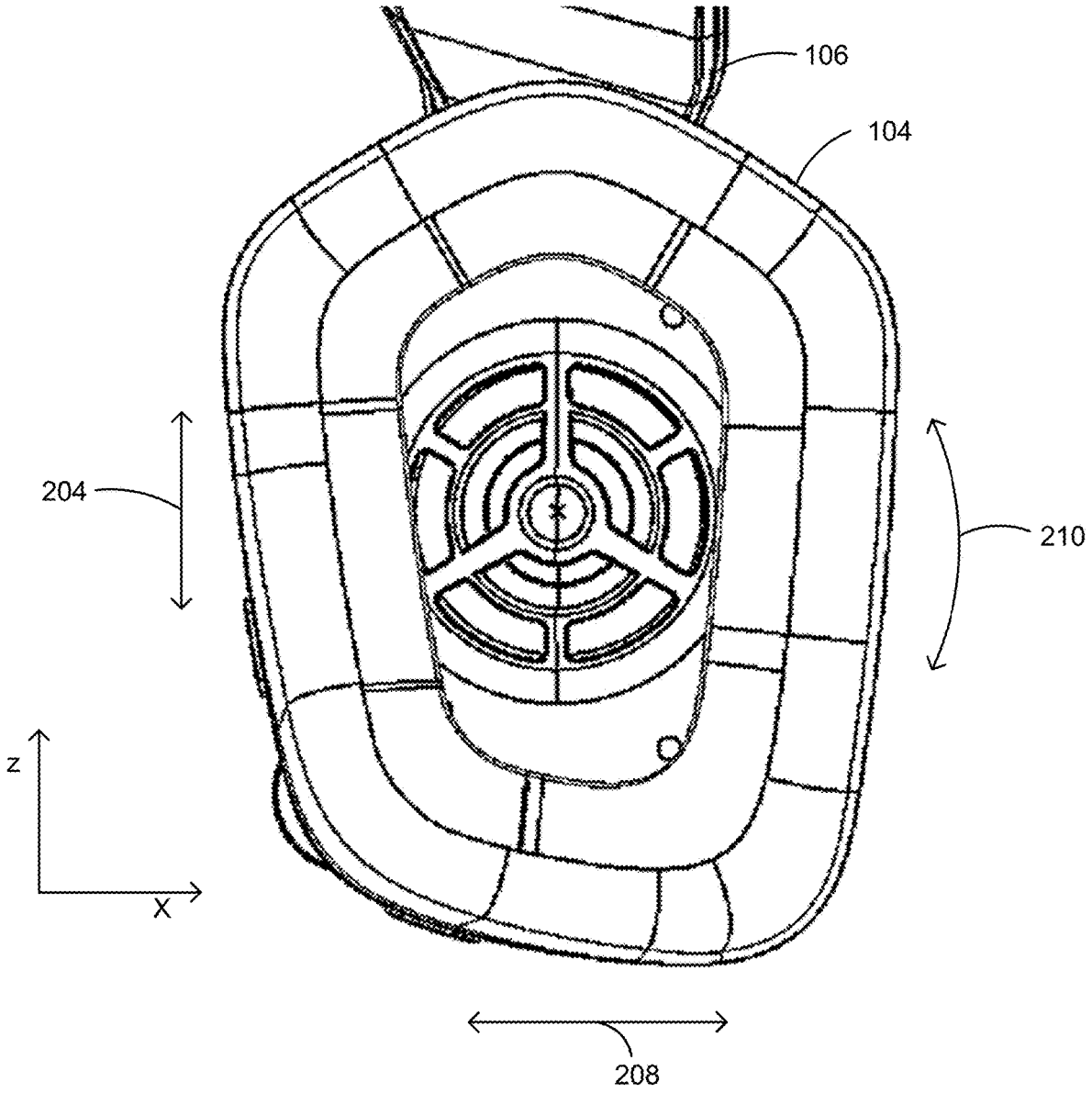
Figure 2C:
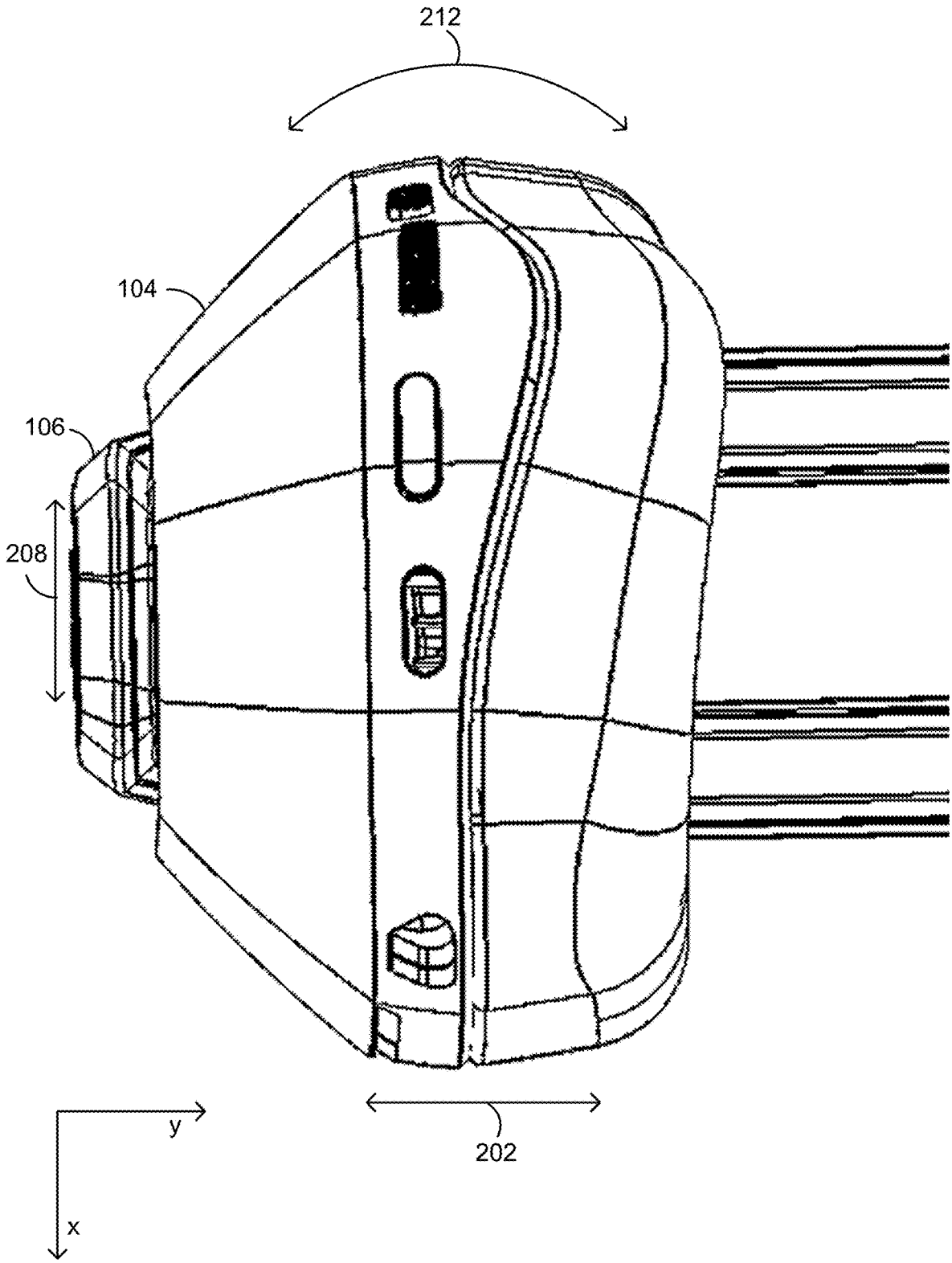

FIGS. 2A-2C shows views of portions of a headset 100 showing only one side including an earpiece 104 and an end 106 of the headband 102. In embodiments, the relative movement allowed by the couplings, as disclosed herein, may be included in the connections between one or both earpieces 104 to the ends 106 of the headband 102. FIGS. 2A-2C define the terminology for planes, directions of translation and directions of rotation for the technology disclosed herein.

FIG. 2A shows a profile view of an earpiece 104 and the end 106 of a headband 102 in a YZ plane, with the X direction extending perpendicular to the YZ plane. As shown, the coupling between the earpiece 104 and the end 106, as will be described in greater detail below, may allow for relative motion including one or more of Y-translation 202, Z-translation 204, and X-rotation 206.

FIG. 2B shows an inner side view of an earpiece 104 and the end 106 of a headband 102 in an XZ plane, with the Y direction extending perpendicular to the XZ plane. As shown, the coupling between the earpiece 104 and the end 106, as will be described in greater detail below, may allow for relative motion including one or more of X-translation 208, Z-translation 204, and Y-rotation 210.

FIG. 2C shows a bottom view of an earpiece 104 and the end 106 of a headband 102 in an XY plane, with the Z direction extending perpendicular to the XY plane. As shown, the coupling between the earpiece 104 and the end 106, as will be described in greater detail below, may allow for relative motion including one or more of X-translation 208, Y-translation 202, and Z-rotation 212.

FIG. 3A shows a cross-section view, in the YZ plane, of a portion of a headset 100 including an end 106 of a headband 102 and an earpiece 104. In embodiments, for example as shown, an earpiece 104 may include an outer housing 302, an audio driver 306, and an ear pad 304. The audio driver 306 is positioned within and is fixedly coupled to the outer housing 302. The ear pad 304 is coupled to the outer housing 302 opposite a membrane coupling 308 connecting the end 106 of the headband 102 to the outer housing 302, so that when the headset 100 is worn by a user the headband 102 exerts a clamping force onto the outer housing 302 pressing the ear pad 304 against the user's head so that the audio driver 306 is positioned proximate to the user's ear.

FIG. 3B shows a close-up cross-sectional view of a membrane coupling 308. As shown, a membrane coupling 308 may include a membrane insert 310. The outer perimeter of the membrane insert 310 may be coupled to the outer housing 302. The membrane coupling 308 may further include a connection pin 312 extending through the membrane insert 310 and coupled to a portion of the end 106 of the headband 102. In embodiments, the portion of the end of the headband to which the connection pin is coupled may be a fixed, i.e. non-movable, point on the headband, for example a cylindrical screw boss. In embodiments, for example as shown in FIG. 3B, the portion of the end 106 of the headband 102 which the connection pin 312 is coupled to may be a ball 314. The end 106 of the headband 102 may further include a socket receiving the ball 314. In embodiments, the ball 314 may be rotatable within the socket and may define a ball joint with 1, 2, or 3 degrees of rotational freedom separate from the rotational degrees of freedom of the membrane coupling. In embodiments, the ball 314 may not be rotatable within the socket and may define a fixed joint.

Figure 4A:
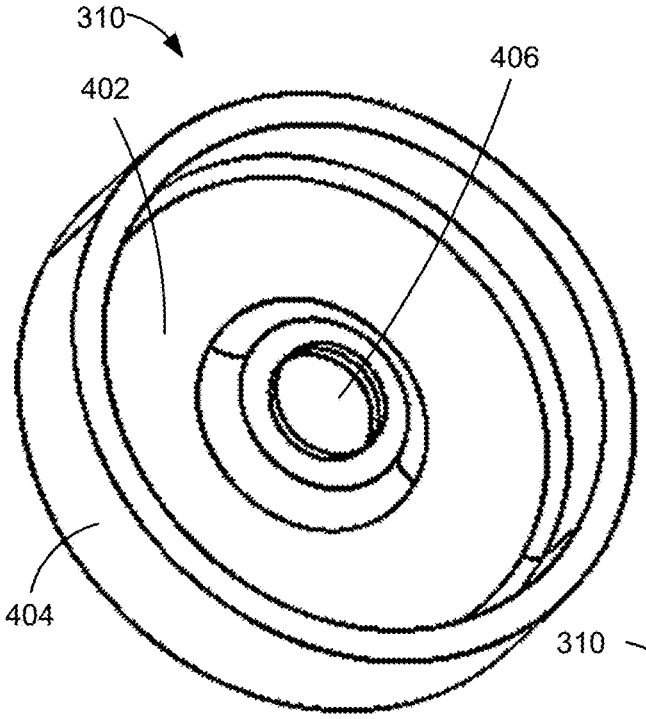
FIGS. 4A-4C show views of a membrane insert, according to embodiments of the present technology.
Figure 4C:
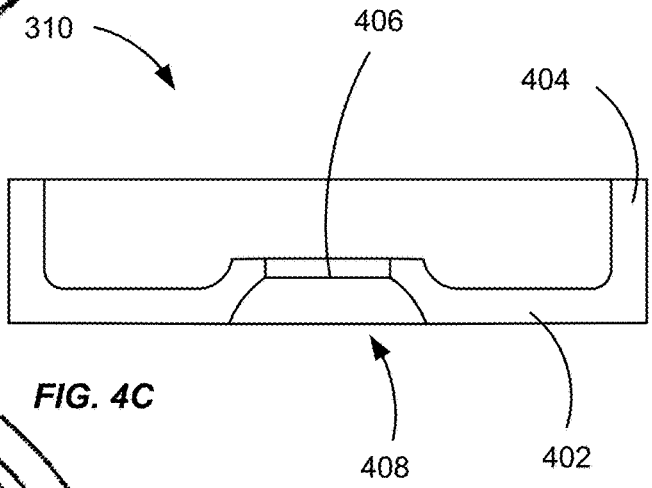
Figure 4B:
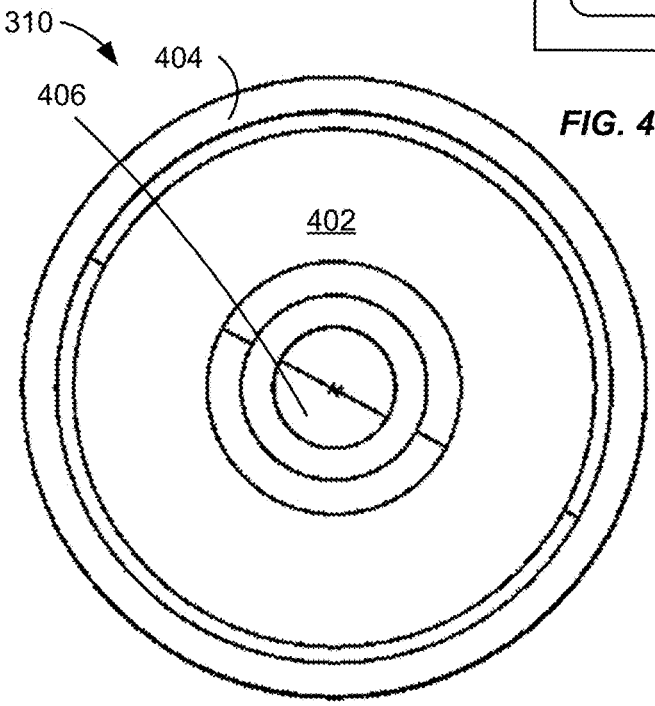

FIGS. 4A-4C shown an embodiment of a membrane insert 310. The membrane insert 310 may include a central portion 402 and a flange portion 404. In the orientations shown herein, the central portion 402 is may be substantially planar on the XZ plane, wherein dimensions in the X and Z directions are greater than dimensions in the Y directions. In embodiments, the membrane insert 310 may have any profile in the XZ plane. In the embodiments shown in FIGS. 4A-4C, the central portion 402 of the membrane insert 310 defines a circular profile in the XZ plane. In embodiments, the central portion may be other shapes including oblong or rectangular. In embodiments, the flange portion 404 may be coplanar and/or parallel with a plane of the central portion 402, or may extend perpendicularly to a plane of the central portion 402.

The central portion 402 may define an opening 406 for receiving a connection pin to couple the membrane insert to the end of the headband. In embodiments, the opening 406 may be located in the center of the central portion. In embodiments, the opening 406 may off center. In embodiments, with off center openings and or non-circular profiles, the opening will located at non-uniform distances from a perimeter of the central portion. The non-uniform distances may be beneficial in defining different ranges of motion and/or different magnitudes of restoring force in one or more of the six degrees of freedom. For example, an oblong profile may allow for greater translation in a direction of the long axis compared to a direction of the short axis. Similarly, a rectangular profile may allow for greater translation in a direction of a diagonal axis compared to a direction of a non-diagonal. In embodiments, a rectangular or polygonal profile may include rounded corners.

In embodiments, the membrane insert is formed of one or more resilient materials, so that upon being stressed due to an outside force causing relative movement in one of the six degrees of freedom, the membrane insert is able to deform elastically and in response to the outside force subsiding release absorbed energy to reverse the deformation back to an original state. In embodiments, the membrane insert may be made of plastics, for example thermoplastic polyurethane, rubbers (e.g. natural, silicone), and fabric. In embodiments, the insert membrane, or portions thereof, for example the central portion, may be a fabric, for example a woven fabric.

In embodiments, the resilience of the different portions of the membrane insert may vary. In embodiments, difference resilience may be achieved with different materials, different thicknesses, and/or different hardness. In embodiments, the membrane insert may have a uniform resilience. For example, as shown in FIG. 4C, the central portion 402 may have a substantially uniform thickness and have a uniform resilience. In embodiments, the portions of the central portion 402 around the opening 406 may be raised or thicker than surrounding portions of the central portion 402, for example as shown in FIGS. 4A and 4C.

In embodiments, the central portion 402 may define a recess 408 sized and shaped to receive a portion of the end 106 of the headband 102. For example, the recess 408 may be hemispherical to receive the ball 314 of the end 106 of the headband 102. In embodiments, the central portion 402 may have a variable thickness, for example different thicknesses at different radial distances and/or direction radial directions.

In embodiments, the membrane insert 310 may be formed by injection molding. In embodiments, the outer housing 302 may be formed of a material that is stiffer and has less resilience than the membrane insert 310. In embodiments, the membrane insert 310 and outer housing 302 may be formed in a dual injection molding process wherein the outer housing 302 is first molded of a first material followed by the membrane insert being molding into the outer housing 302 with a second material. In embodiments, the outer housing 302 and insert membrane may be formed separately and adhered together.

Figure 5A:
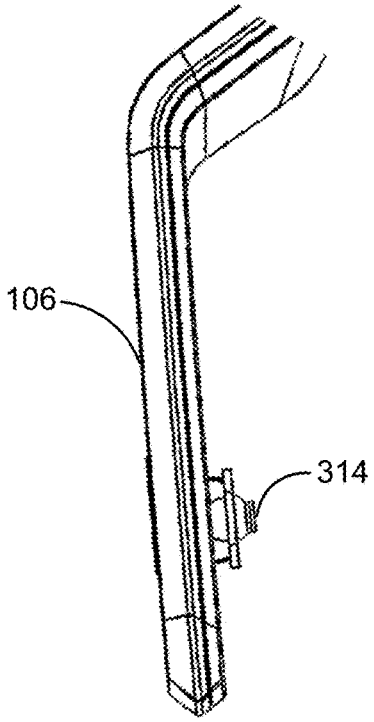
FIGS. 5A-5D show views of an end of a headband and a membrane insert coupled to an end of a headband, according to embodiments of the present technology.
Figure 5B:
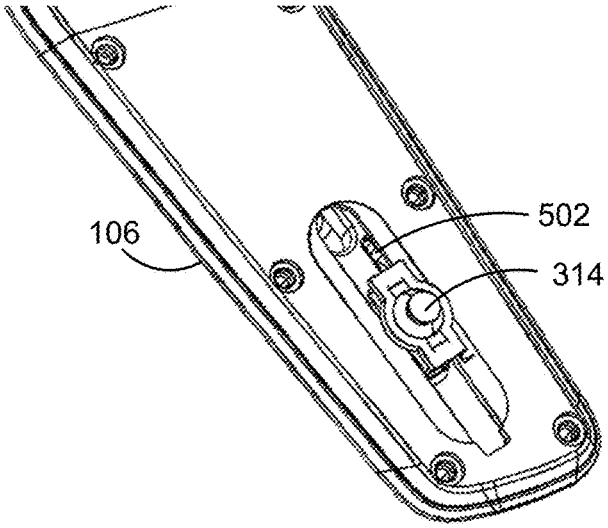
Figure 5C:
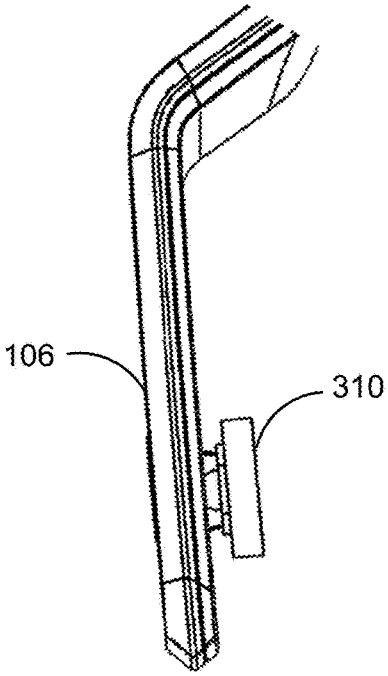
Figure 5D:
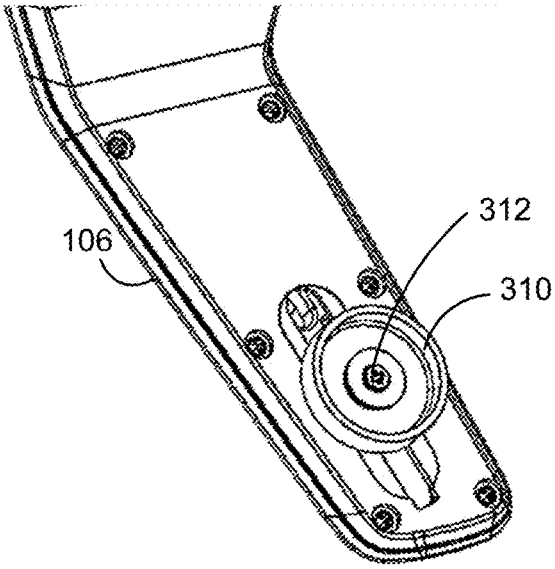

FIGS. 5A and 5B show an end 106 of a headband 102 without an earpiece 104 attached. As shown, the end 106 may include a ball 314 for coupling the earpiece 104 with a membrane coupling 308. However, as noted above, the end 106 may include a fixed point, such as a cylindrical screw boss for coupling the earpiece 104 with a membrane coupling 308. The attachment point, for example the ball 314 or a cylindrical screw boss, may be on an adjustable track 502 allowing for a position in the Z-translational direction, for example via a dial. The position in the Z direction may be set and allows the distance between the top of the headband 102 and the earpiece to be set to different positions to accommodate different sized heads. This type of adjustment with the track 502 is a fixed static adjustment in that once set, unless the adjustment mechanism is further manipulated the translation remains at the user set position without a bias to return to a previous position. As will be discussed in greater detail below, the membrane coupling 308 as disclosed herein allows for unfixed dynamic adjustment, wherein the earpiece is continually movable in one or more degrees of translational and/or rotational freedom and is biased to return toward a neutral position, and therefore is distinct from the type of adjustment using the track 502. FIGS. 5C and 5D show an end 106 of a headband 102 with a membrane insert 310 attached. In embodiments, as noted the membrane insert 310 may be coupled to or formed integrally with the earpiece, or a portion thereof, prior to attaching the membrane insert 310 to the end 106 of the headband.

Figure 6A:
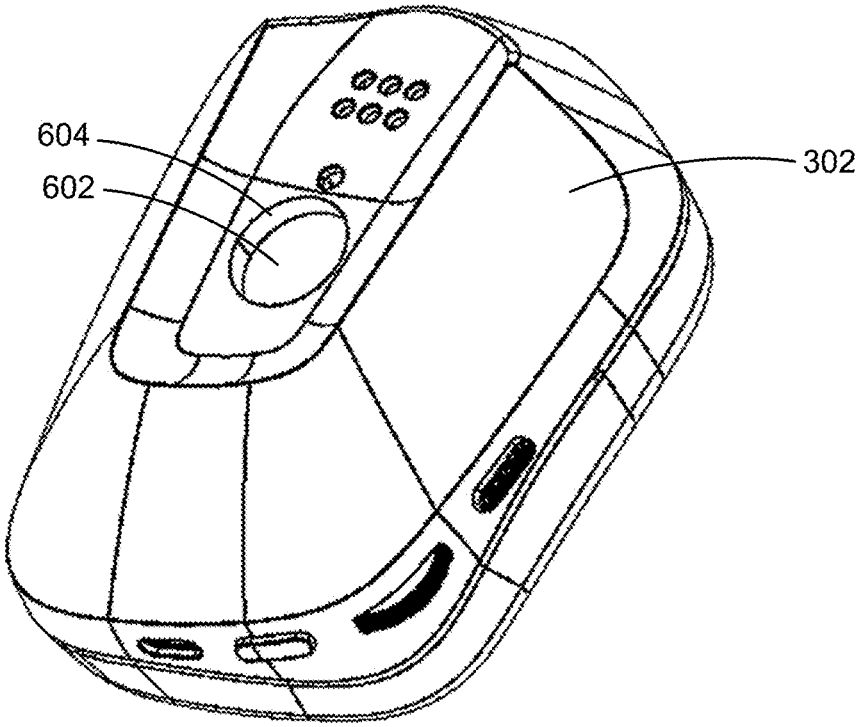
FIGS. 6A and 6B show views of an earpiece and a membrane insert coupled to an earpiece, according to embodiments of the present technology.
Figure 6B:
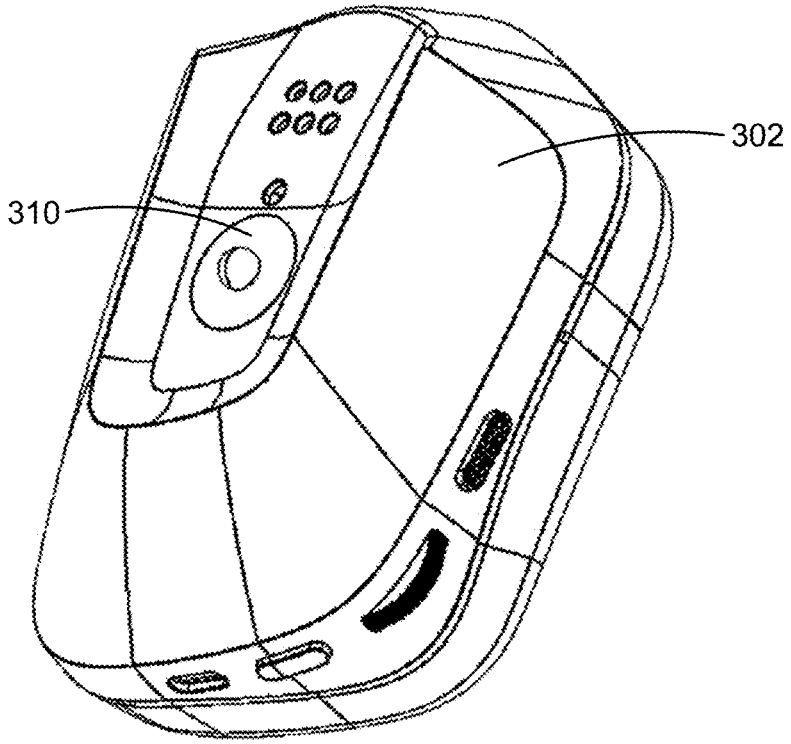
Figure 7A:
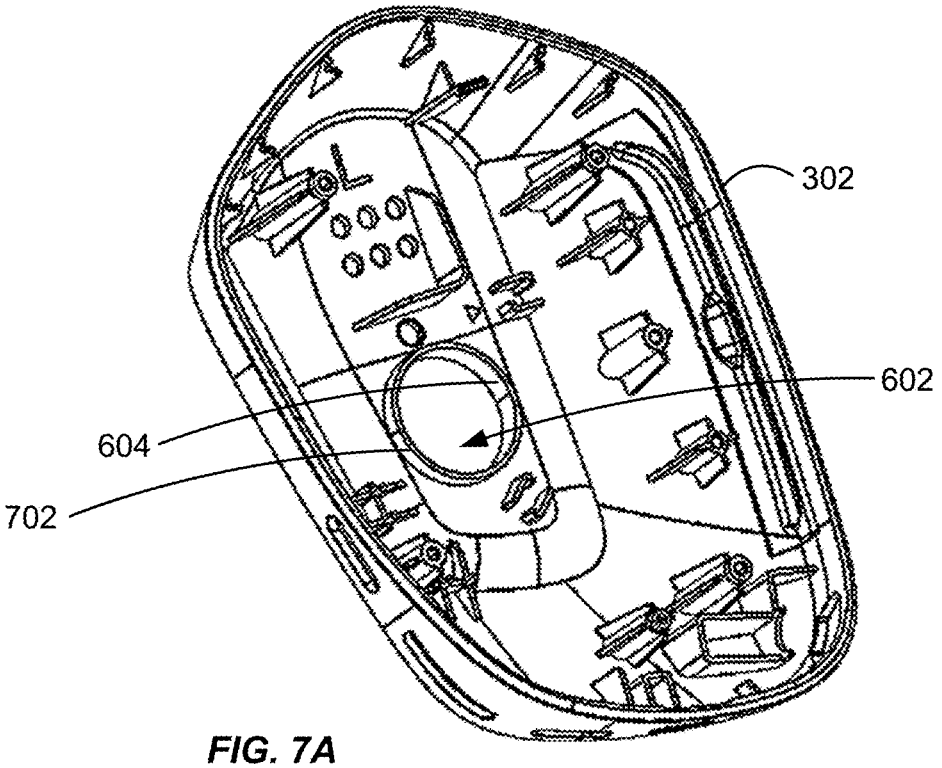
FIGS. 7A-7C show views of an outer housing of an earpiece and a membrane insert coupled to an outer housing of an earpiece, according to embodiments of the present technology.
Figure 7B:
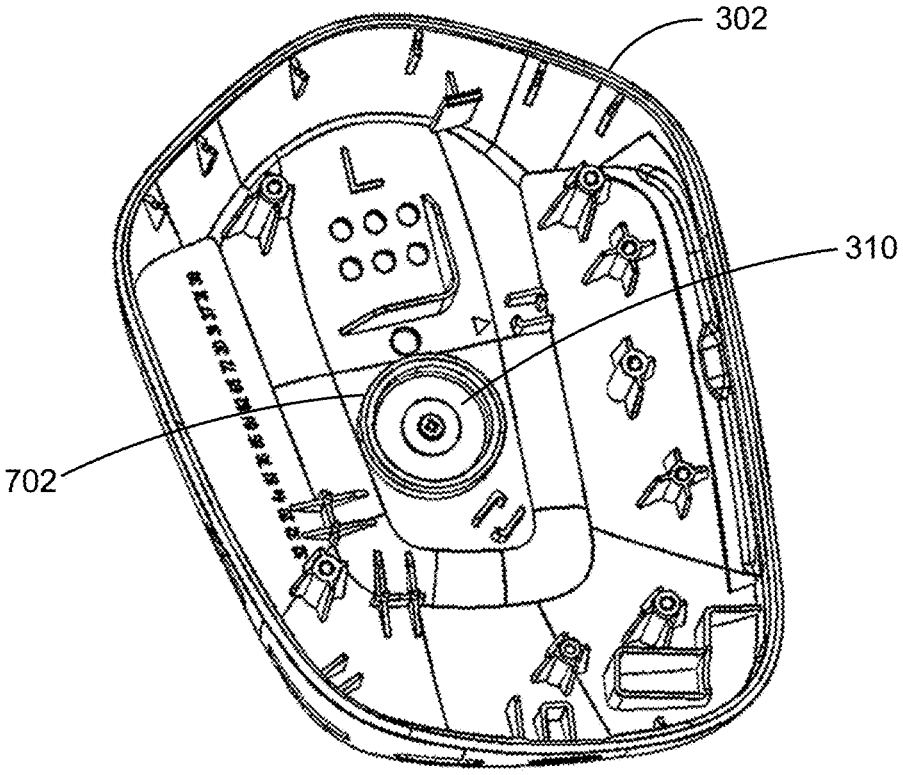

As shown in FIGS. 3A and 3B, the membrane insert 310 is received within the outer housing 302 of an earpiece 104. In embodiments, for example as shown in FIG. 6A, the outer housing 302 of an earpiece 104 may define an opening 602 for receiving a membrane insert 310 The opening 602 may be shaped and sized to correspond to the shape and size of the membrane insert 310 so that the flange 404 contacts the inner sidewall 604 of the opening 602. In embodiments, for example as shown in FIGS. 6A and 6B, and FIGS. 7A and 7B, the opening 602 may be circular to accommodate a circular membrane insert 310. As shown in FIGS. 7A and 7B, the outer housing 302 may include a flange 702 around the opening 602. The flange 702 may have the same height as the flange 404 of the membrane insert 310 so that the membrane insert is fitted flush within the outer housing 302, as shown in FIGS. 6B and 7B.

Figure 7C:
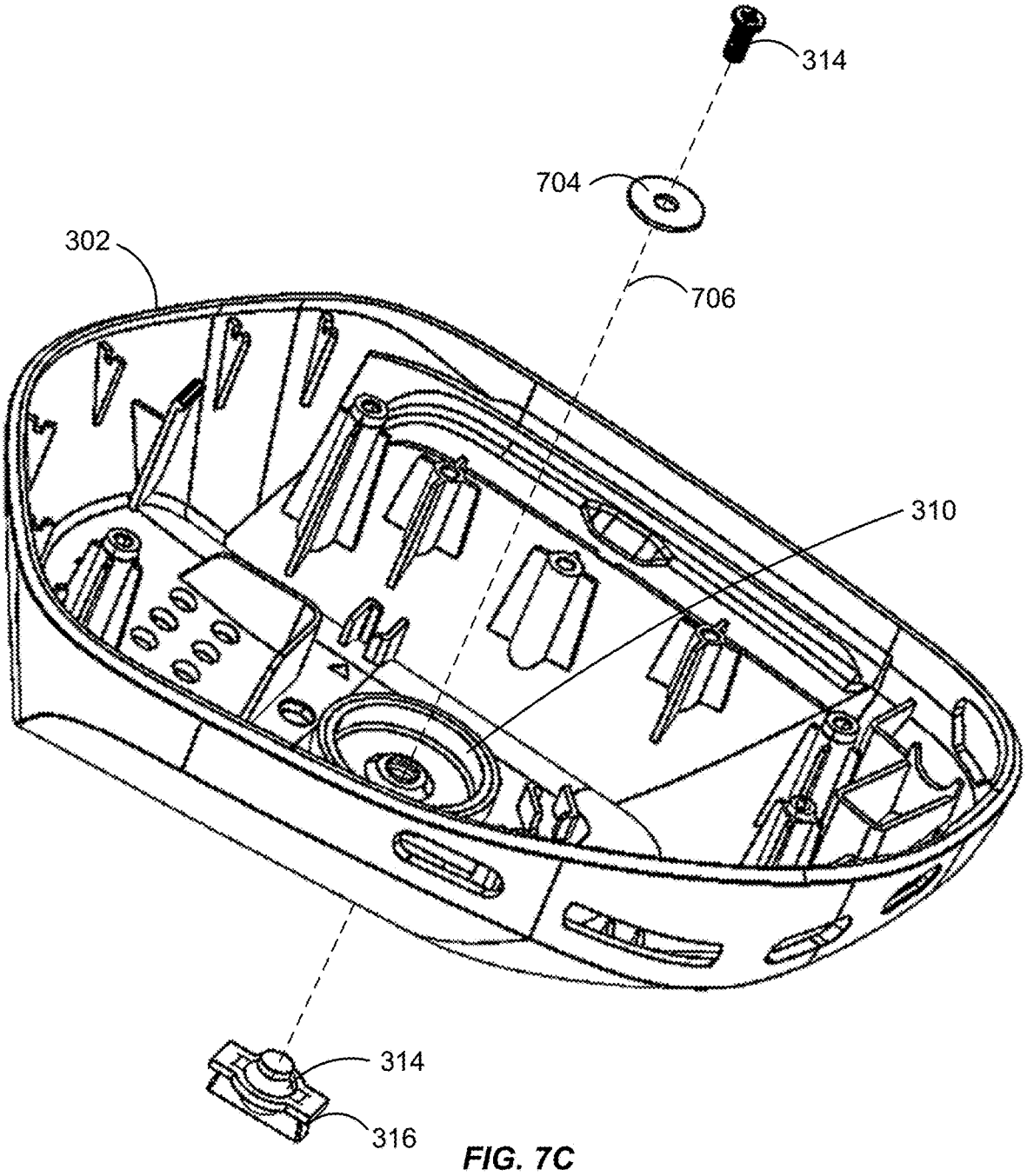

In embodiments, the membrane insert 310 is coupled to or formed integrally with the outer housing 302 of the earpiece prior to coupling the membrane insert to the end 106 of the headband 102. FIG. 7C shows an exploded view of the connection of the membrane insert 310 a portion of the end 106 of the headband 102, which in this example is the assembly of the ball 314 and socket with the remaining portion of the end 106 omitted in the figure for clarity. As shown the connection pin 312, in the form of a screw, extends through a washer 704, through the opening 406 of the membrane insert 310, and into the ball 314. In embodiments, an additional washer may be present between the membrane inset 310 and the end 106. The direction of extension of the connection may be perpendicular to a plane of the central portion 402 of the membrane insert 310 and may be referred to as a connection axis 706.

In embodiments, during manufacturing the assembly of the outer housing 302 and membrane insert 310 is coupled to the end 106 of the headband 102 prior to coupling the audio driver 306 and ear pad 304 to the outer housing 302. In embodiments, the connection pin 312 may extend from the end 106 of the headband 102 into the central opening 406 so that the connection pin can be removed and earpiece uncoupled from the headband without removing the audio driver 306 from the outer housing 302.

FIGS. 8A-8C, 9A-9C, 10A-1C, 11A-11C, 12A-12C and 13A-13C show cross-sectional views of an embodiment of an earpiece and membrane coupling assembly in order to depict deflections of portions of the membrane insert due to translations and rotations about the X Y and Z axes. These figures show relative movement in a single degree of freedom, the membrane coupling as disclosed herein may simultaneously allow for any combination of relative movement in one to up to six degrees of freedom.

Figure 8C:
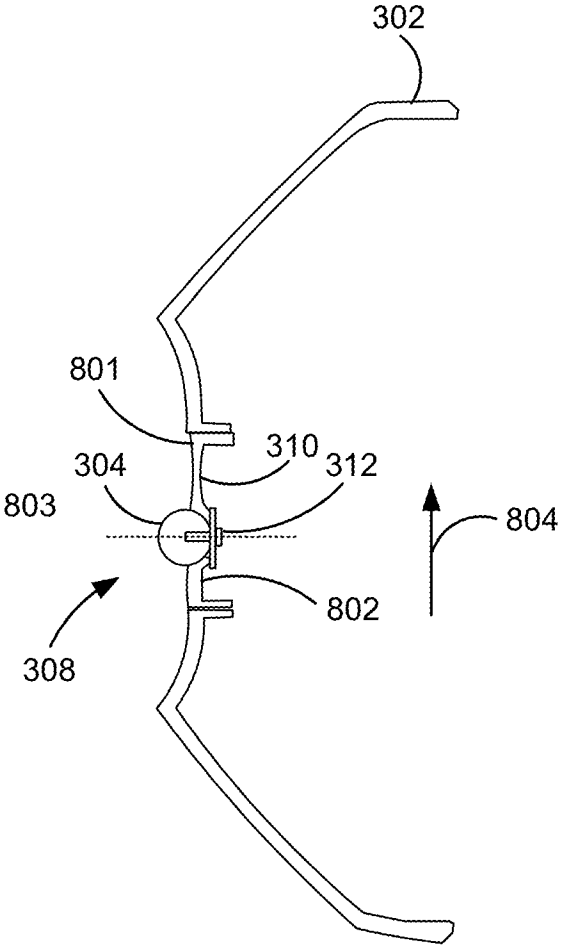
FIGS. 8A-8C show translation in an X-direction of an earpiece relative to a membrane insert, according to embodiments of the present technology.
Figure 8B:
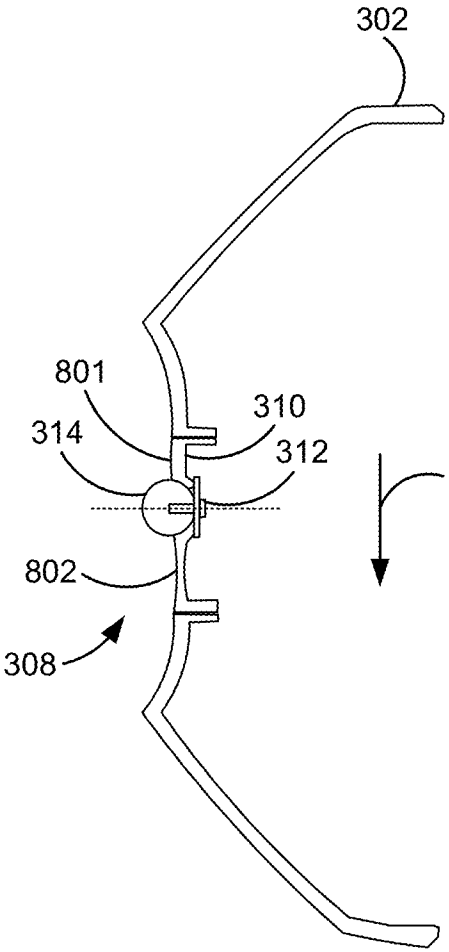
Figure 8A:
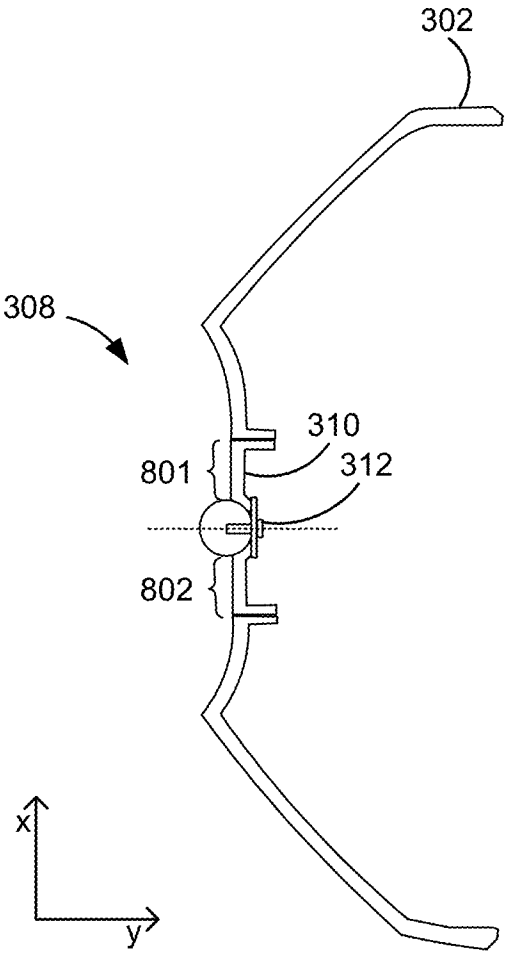

FIGS. 8A-8C show cross-sectional views in an XY plane of an earpiece assembly including the outer housing 302, the membrane insert 310, the connection pin 312 and the ball 314 in order to show X-translation. In FIG. 8A the membrane coupling 308 is an X-translation neutral position. As shown, the central opening of the membrane insert 310 through which the connection pin 312 is coupled is positioned between a front portion 801 and a rear portion 802 of the membrane insert 310. In the neutral position shown in FIG. 8A, the front portion 801 and the rear portion 802 are unstressed, e.g. not stretched or compressed, in relation to X-translation. Due to an outside force in the X-direction, the earpiece outer housing 302 may be caused to translate in the X-direction relative to the connection pin 312 and connection point of the end 106 of the headband, in this example the ball 314, resulting in the front portion 801 and the rear portion 802 of the membrane insert 310 being stressed. For example, as shown in FIG. 8B, the earpiece outer housing 302 may be caused to translate in a first X-direction 803 relative to the connection pin 312 causing the front portion 801 to be compressed and the rear portion 802 to be stretched. Similarly for example, as shown in FIG. 8C, the earpiece outer housing 302 may be caused to translate in a second X-direction 804, opposite the first X-direction 803, relative to the connection pin 312 causing the front portion 801 to be stretched and the rear portion 802 to be compressed. Due to the resilient properties of the membrane insert 310 the stretching and/or compressing of one or more of the front portion 801 and/or the rear portion 802 may cause a restoring force biasing relative motion of the earpiece outer housing 302 and the connection pin 312 back to the neutral position in relation to X-translation.

Figure 9C:
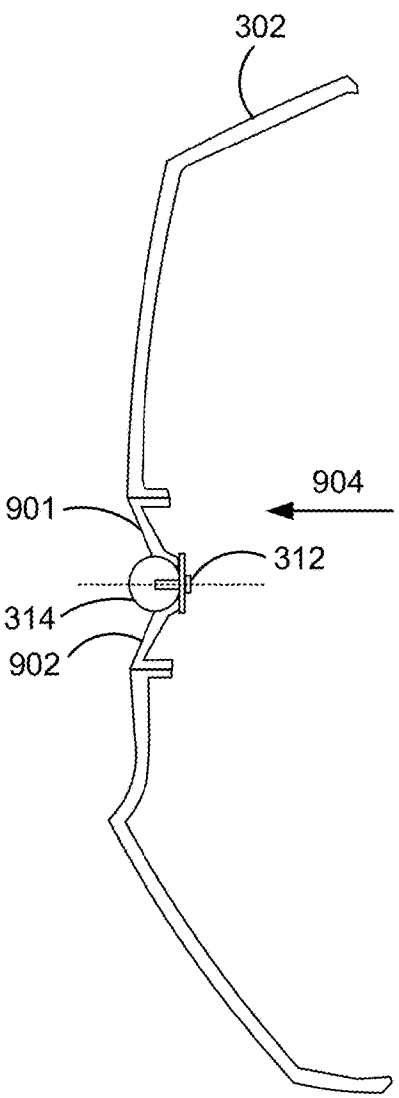
FIGS. 9A-9C show translation in a Y-direction of an earpiece relative to a membrane insert, according to embodiments of the present technology.
Figure 9B:
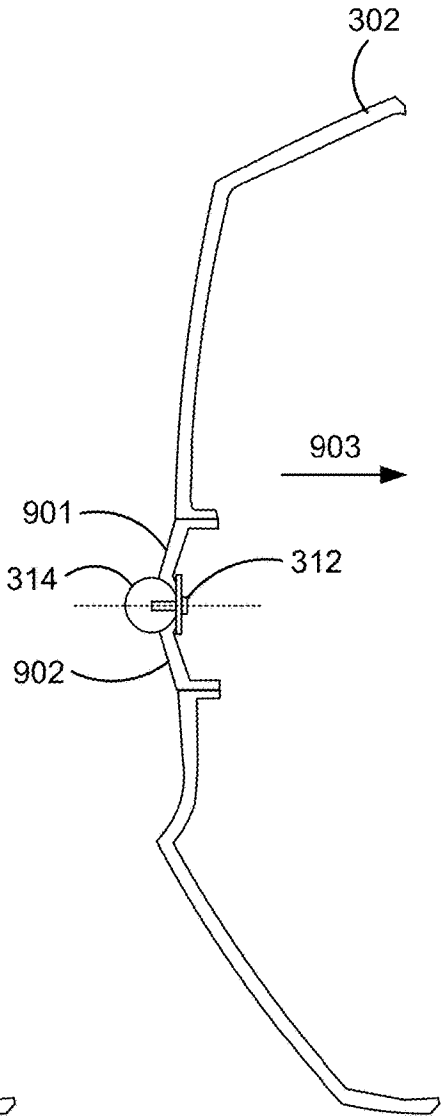
Figure 9A:
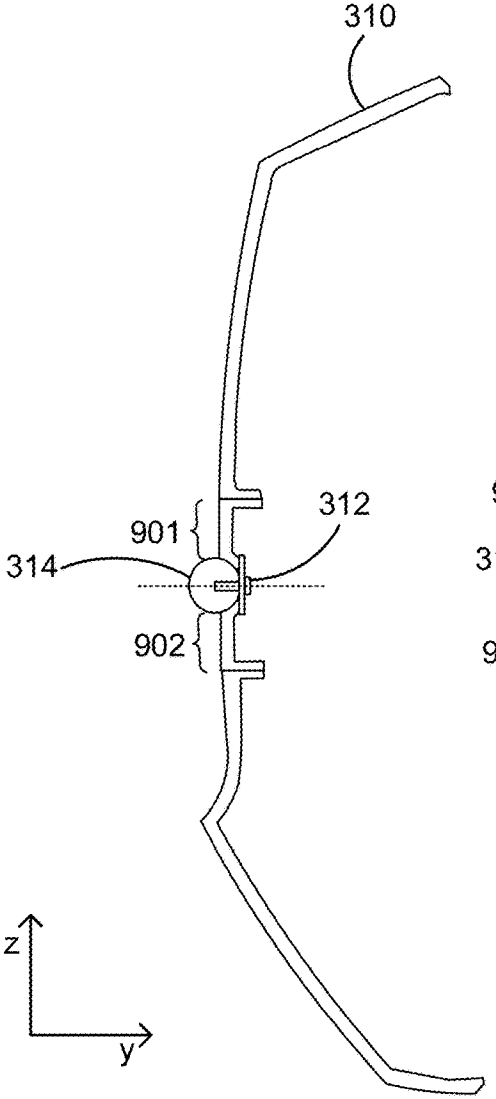

FIGS. 9A-9C shows cross-sectional views in a YZ plane in order to show Y-translation.

As shown, the central opening of the membrane insert 310 through with the connection pin 312 is coupled is positioned between an upper portion 901 and a lower portion 902 of the membrane insert 310. In the neutral position shown in FIG. 9A, the upper portion 901 and the lower portion 902 are unstressed, e.g. not stretched or compressed, in relation to Y-translation. Due to an outside force in the Y-direction, the earpiece outer housing 302 may be caused to translate in the Y-direction relative to the connection pin 312 resulting in the upper portion 901 and the lower portion 902 of the membrane insert 310 being stressed. For example, as shown in FIG. 9B, the earpiece outer housing 302 may be caused to translate in a first Y-direction 903 relative to the connection pin 312 causing the upper portion 901 and the lower portion 902 to be stretched with the central opening 406 and connection pin 312 coupled thereto translating out of and away from the earpiece outer housing 302. Similarly for example, as shown in FIG. 9C, the earpiece outer housing 302 may be caused to translate in a second Y-direction 904, opposite the first Y-direction 903, relative to the connection pin 312 causing the upper portion 901 and the lower portion 902 to be stretched with the central opening 406 and connection pin 312 coupled thereto translating into the earpiece outer housing 302. The Y-direction translation as shown in FIG. 9C may be caused due to a clamping force exerted by the headband 102. Due to the resilient properties of the membrane insert 310 the stretching of one or more of the upper portion 901 and/or the lower portion 902 may cause a restoring force biasing relative motion of the earpiece outer housing 302 and the connection pin 312 back to the neutral position in relation to Y-translation.

Figures 10A, 10B, 10C:
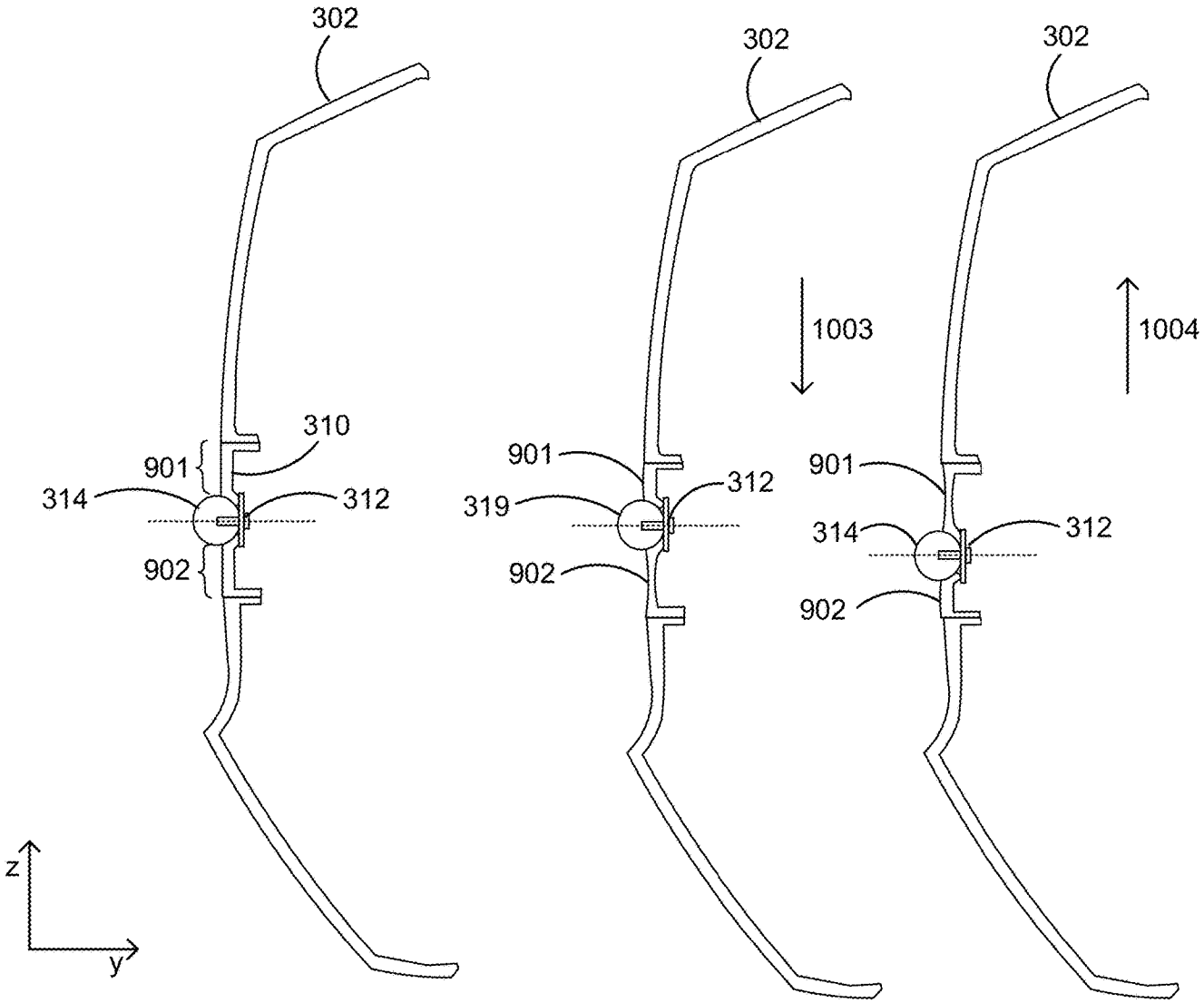
FIGS. 10A-10C show translation in a Z-direction of an earpiece relative to a membrane insert, according to embodiments of the present technology.

FIGS. 10A-10C shows cross-sectional views in a YZ plane to show Z-translation. As shown, the central opening 406 through with the connection pin 312 is coupled to the ball 314 is positioned between the upper portion 901 and the lower portion 902 of the membrane insert 310. In the neutral position shown in FIG. 10A, the upper portion 901 and the lower portion 902 are unstressed, e.g. not stretched or compressed, in relation to Z-translation. Due to an outside force in the Z-direction, the earpiece outer housing 302 may be caused to translate in the Z-direction relative to the connection pin 312 and ball 314 coupled thereto resulting in the upper portion 901 and the lower portion 902 of the membrane insert 310 being stressed. For example, as shown in FIG. 9B, the earpiece outer housing 302 may be caused to translate in a first Z-direction 1003 relative to the connection pin 312 causing the upper portion 901 to be compressed and the lower portion 902 to be stretched. Similarly for example, as shown in FIG. 10C, the earpiece outer housing 302 may be caused to translate in a second Z-direction 1004, opposite the first Z-direction 1003, relative to the connection pin 312 causing the upper portion 901 to be stretched and the lower portion 902 to be compressed. Due to the resilient properties of the membrane insert 310 the stretching and/or compressing of one or more of the upper portion 901 and/or the lower portion 902 may cause a restoring force biasing relative motion of the earpiece outer housing 302 and the connection pin 312 back to the neutral position in relation to Z-translation.

Figures 11A, 11B, 11C:
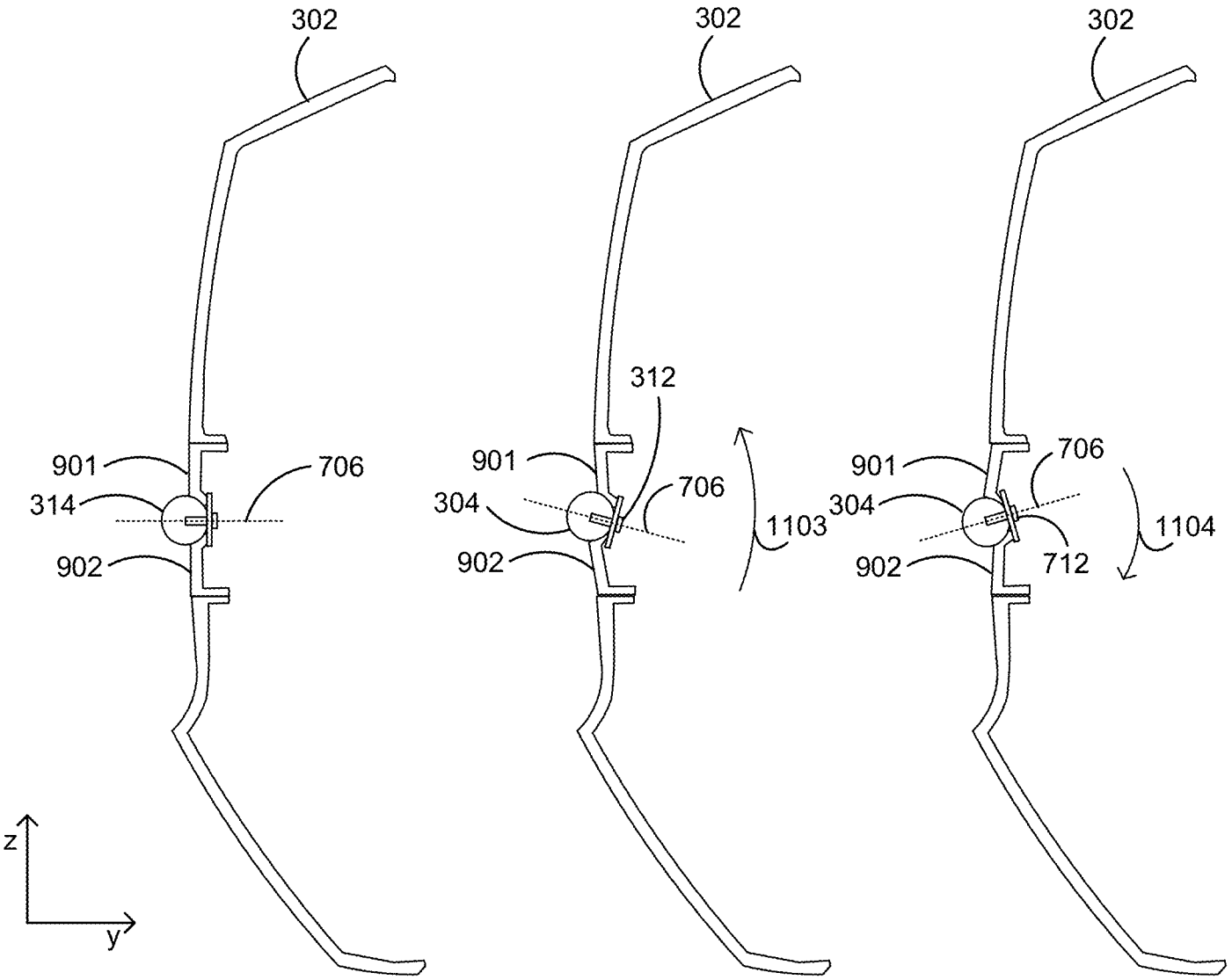
FIGS. 11A-11C show rotation around an X-axis of an earpiece relative to a membrane insert, according to embodiments of the present technology.

FIGS. 11A-11C show cross-sectional views in a YZ plane to show X-rotation. FIG. 11A shows an X-rotation neutral position, wherein the connection axis 706 is aligned parallel to the Y-axis, however in embodiments the connection axis 706 may be in other X-rotation orientations in the neutral position of X-rotation. In the X-rotation neutral position shown in FIG. 11A, the upper portion 901 and the lower portion 902 are unstressed, e.g. not stretched or compressed, in relation to X-rotation. However, as noted, the membrane coupling 308 may allow for simultaneous movements in different degrees of freedom and therefore portions of the membrane insert 310, for example the upper portion 901 and lower portion 902, may be stressed due to movement in the other degrees of freedom. Regarding X-rotation, due to an outside rotating force around the X-axis, for example during adjustment/placement of the headset 100 on the head of a wearer, the earpiece outer housing 302 may be caused to rotate around the X-axis relative to the connection pin 312 resulting in deflections and stressing of one or more of the upper portion 901 and/or lower portion 902. The deflections may be along the Y-direction and may be in opposite directions into and/or out of the earpiece outer housing 302, or if combined with motions in other degrees of freedom deflections of the upper portion 901 and lower portion 902 may have a different magnitudes in the same direction also as a result of X-rotation. The deflections and/or stressing of one or more the upper portion 901 and/or lower portion 902 allows of the connection axis 706 to rotate around the X-axis from the X-rotation neutral position. For example, as shown in FIG. 11B, the earpiece outer housing 302 may be caused to rotate a first rotational direction 1103 around the X-axis relative to the connection pin 312 causing the upper portion 901 to deflect into the earpiece outer housing 302 and the lower portion 902 to deflect out of the earpiece outer housing 302. Similarly for example, as shown in FIG. 11C, the earpiece outer housing 302 may be caused to rotate a second rotational direction 1104, opposite the first rotational direction 1103, around the X-axis relative to the connection pin 312 causing the upper portion 901 to deflect out of the earpiece outer housing 302 and the lower portion 902 to deflect into of the earpiece outer housing 302. The deflection of the upper portion 901 and lower portion 902 may cause stretching and/or bending of different portions of the membrane insert 310. Due to the resilient properties of the central portion of the membrane insert 310 the stretching and/or bending of one or more of the upper portion 901 and/or the lower portion 902 may cause a restoring force biasing relative motion of the earpiece outer housing 302 and the connection pin 312 back to the neutral position in relation to X-rotation.

Figures 12A, 12B, 12C:
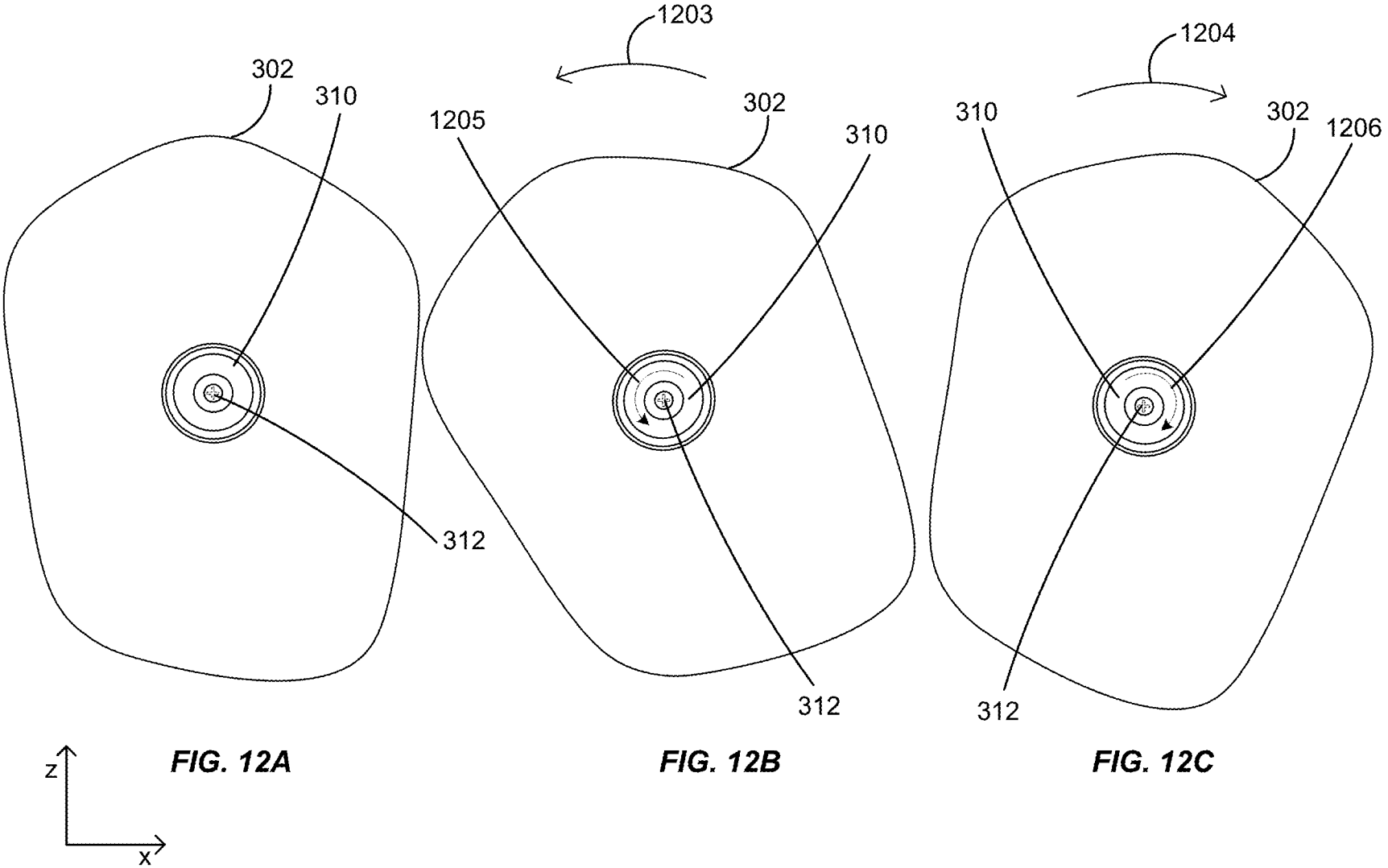
FIGS. 12A-12C show rotation around a Y-axis of an earpiece relative to a membrane insert, according to embodiments of the present technology.

FIGS. 12A-12C show cross-sectional views in an XZ plane to show Y-rotation. In the Y-rotation neutral position shown in FIG. 12A, the central portion 402 of the membrane insert 310 is not rotationally stressed in relation to Y-rotation. Due to an outside rotating force around the Y-axis, for example during adjustment/placement of the headset 100 on the head of a wearer, the earpiece outer housing 302 may be caused to rotate around the Y-axis relative to the connection pin 312 resulting in rotational stretching of the central portion 402 between the flange 404 and the central opening 406. For example, as shown in FIG. 12B, the earpiece outer housing 302 may be caused to rotate a first rotational direction 1203 around the Y-axis relative to the connection pin 312 causing rotational stressing in central portion 402 as indicated by the arrow 1205. Similarly for example, as shown in FIG. 12C, the earpiece outer housing 302 may be caused to rotate a second rotational direction 1204, opposite the first rotational direction 1203, around the Y-axis relative to the connection pin 312 causing rotational stressing in central portion 402 as indicated by the arrow 1206. Due to the resilient properties of the central portion 402 of the membrane insert 310 the rotational stretching may cause a restoring force biasing relative rotational motion of the earpiece outer housing 302 and the connection pin 312 back to the neutral position in relation to Y-rotation.

FIGS. 13A-13C show cross-sectional views in an XY plane to show Z-rotation. In the Z-rotation neutral position shown in FIG. 13A, the connection axis 706 is aligned in the Y-direction, however in embodiments the connection axis 706 may be in other Z-rotation orientations in the neutral position of Z-rotation. In the Z-rotation neutral position shown in FIG. 13A, the front portion 801 and the rear portion 802 are unstressed, e.g. not stretched nor compressed, in relation to Z-rotation. Due to an outside rotating force around Z-axis, for example during adjustment/placement of the headset 100 on the head of a wearer, the earpiece outer housing 302 may be caused to rotate around the Z-axis relative to the connection pin 312 resulting in deflections and stressing of one or more the front portion 801 and/or rear portion 802. The deflections may be along the Y-direction and may be in opposite directions into and/or out of the earpiece outer housing 302, or if combined with motions in other degrees of freedom deflections of the front portion 801 and rear portion 802 may have a different magnitude in the same direction. The deflections and/or stressing of one or more the front portion 801 and/or rear portion 802 allows for the connection axis 706 to rotate around the Z-axis from the Z-rotation neutral position. For example, as shown in FIG. 13B, the earpiece outer housing 302 may be caused to rotate a first rotational direction 1303 around the Z-axis relative to the connection pin 312 causing the front portion 801 to deflect into the earpiece outer housing 302 and the rear portion 802 to deflect out of the earpiece outer housing 302. Similarly for example, as shown in FIG. 13C, the earpiece outer housing 302 may be caused to rotate a second rotational direction 1304, opposite the first rotational direction 1303, around the Z-axis relative to the connection pin 312 causing the front portion 801 to deflect out of the earpiece outer housing 302 and the rear portion 802 to deflect into of the earpiece outer housing 302. The deflection of the front portion 801 and rear portion 802 may cause stretching and/or bending of the central portion 402. Due to resilient properties of the central portion 402 of the membrane insert 310 the stretching and/or bending of one or more of the front portion 801 and/or the rear portion 802 may cause a restoring force biasing relative motion of the earpiece outer housing 302 and the connection pin 312 back to the neutral position in relation to Z-rotation.

As noted, the translations and rotations of FIGS. 8A-13C are examples of single degree of freedom relative motion between the connection pin 312 and earpiece outer housing 302. In embodiments, the relative motion between the connection pin 312 and earpiece outer housing 302 may occur in any combination of the one or more of the six degrees shown, and the stressing of the front portion 801, rear portion 802, upper portion 901, and lower portion 902 will be a combination of the stretching, compressing, and bending of the individual degree of freedom components of the multiple degree of freedom relative motion.

The relative motion between the connection pin 312 and earpiece outer housing 302 may include physical range of motion limits and/or threshold force range of motion limits. In embodiments, one or more degrees of freedom may include a physical range of motion limit which may include the connection pin 312 or another portion of the membrane coupling 308 contacting the earpiece outer housing 302 and/or another portion of the headset assembly. For example, regarding X-translation and Y-translation, the range of motion may be limited to a relative orientation of the connection pin 312 and earpiece outer housing 302 wherein the connection pin 312 contacts the flange 404 of the membrane insert 310. Further for example, regarding X-rotation and Z-rotation, the range of motion may be limited to a relative orientation of the connection pin 312 and earpiece outer housing 302 wherein the connection pin 312 contacts the flange 404 of the membrane insert 310 or another component of the headset assembly. Further for example, regarding X-rotation, the range of motion may be limited by the membrane insert 310 contacting a portion of the end 106, for example a constraint rib 316 as shown in FIGS. 3B and 7B. The constraint rib 316 may extend longitudinally in the Z-direction to constrain X-rotation but not Z-rotation.

In embodiments, the relative motion between the connection pin 312 and earpiece outer housing 302 may also include threshold force range of motion limits corresponding to the restoring force due to the resilient properties of the central portion 402. During stressing of the central portion 402 the restoring force may increase as the amount of relative movement increases. For example, the greater the Y-translation in the 904 direction as shown in FIG. 9C, the greater the restoring force is biasing the relative motion in a direction back toward the neutral position show in FIG. 9A. In some embodiments, resilient properties of the membrane insert 310 may be selected so that a maximum degree of relative movement in a degree of freedom results in a restoring force equal in magnitude to the maximum typical user input force. For example, in some embodiments, the resilient properties of the membrane insert 310 are selected so that the earpiece outer housing 302 does not contact the end 106 of the headband during Y-translation in the second direction 904, wherein the restoring force of the membrane insert 310 at the relative Y-translation position just before contact of the outer housing 302 with the end 106 is equal in magnitude to the maximum clamping force of the headband 102.

In embodiments, the shape, thickness, and dimensions of the membrane insert 310 may be selected based on a desired range of motion for one or more degrees of freedom. The range of motion in X-translation may be set based on the dimension of the membrane insert 310 in the X-direction, wherein greater dimensions result in greater ranges of motion. The range of motion in Y-translation may be set based on the dimensions of the membrane insert 310 in the X-direction and the Z-direction, and the resilient properties of the membrane insert, wherein greater dimensions and/or greater resilient properties result in greater ranges of motion. The range of motion in Z-translation may be set based on the dimension of the membrane insert 310 in the Z-direction, wherein greater dimensions result in greater ranges of motion.

The range of motion in X-rotation may be set based on the dimension of the membrane insert 310 in the Z-direction in combination with the resilient properties of the membrane insert 310, wherein greater dimensions and/or greater resilient properties result in greater ranges of motion. The range of motion in Y-rotation may be set based on the dimensions of the membrane insert 310 in the X-direction and the Z-direction, and the resilient properties of the membrane insert, wherein greater dimensions and/or greater resilient properties results in a greater range of motion. The range of motion in Z-rotation may be set based on the dimension of the membrane insert 310 in the X-direction, and the resilient properties of the membrane insert, wherein greater dimensions and/or greater resilient properties results in a greater range of motion.

As noted, the resilient properties of the membrane insert 310 may be localized based on material thickness, and/or different materials. In embodiments, the front portion 801, rear portion 802, upper portion 901, and lower portion 902 may have the same or different resilient properties. For example, the front portion 801 and the rear portion 802 may be thicker than the upper portion 901 and the lower portion 902 resulting in a greater restoring force in response to an equal amount of translation in the X-direction compared to the Z-direction. Further for example, the different thicknesses of the central portion 402 may define ribs extending from a surface of the central portion. The ribs may extend radially from the central opening to the flange, and/or concentrically around the central opening, in order to define direction specific resiliencies.

Other variations are within the spirit of the present disclosure. Thus, while the disclosed techniques are susceptible to various modifications and alternative constructions, certain illustrated examples thereof are shown in the drawings and have been described above in detail. It should be understood, however, that there is no intention to limit the disclosure to the specific form or forms disclosed, but on the contrary, the intention is to cover all modifications, alternative constructions and equivalents falling within the spirit and scope of the disclosure, as defined in the appended claims. For instance, any of the examples, alternative examples, etc., and the concepts thereof may be applied to any other examples described and/or within the spirit and scope of the disclosure.

The use of the terms "a" and "an" and "the" and similar referents in the context of describing the disclosed examples (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. The phrase "based on" should be understood to be open-ended, and not limiting in any way, and is intended to be interpreted or otherwise read as "based at least in part on," where appropriate. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate examples of the disclosure and does not pose a limitation on the scope of the disclosure unless otherwise claimed. No language in the specification should be construed as indicating any non-claimed element as essential to the practice of the disclosure.

What is claimed is:

1. A headset comprising:

an earpiece comprising an outer housing and an audio driver positioned within and coupled to the outer housing;

a membrane insert composed of a resilient material, wherein the membrane insert comprises a central portion and a flange around a perimeter of the central portion, wherein the central portion defines a central opening and wherein the flange is coupled to the outer housing;

a headband configured to be placed over a head of a user and exert a clamping force on the head of the user; and a connection pin extending through the central opening of the membrane insert and into an end of the headband directly coupling the end of the headband to the membrane insert in order to couple the outer housing to the end of the headband, wherein the coupling of the end of the headband to the outer housing with the membrane insert in between defines a membrane coupling configured to allow relative movement in six degrees of freedom comprising three orthogonal degrees of translation freedom and three orthogonal degrees of rotational freedom, wherein the outer housing defines an opening, and wherein the membrane insert is positioned within the opening so that the flange of the membrane insert is coupled to a flange of the outer housing around the opening.

2. The headset of claim 1, wherein the resilient material is thermoplastic polyurethane.

3. The headset of claim 1, wherein the membrane insert is formed within the opening of the outer housing in a dual injection process.

4. The headset of claim 1, wherein the membrane insert is coupled within the opening with adhesive between the flange of the membrane insert and the flange of the outer housing.

5. The headset of claim 1, wherein the membrane insert and the opening are circular.

6. The headset of claim 1, wherein the membrane insert and the opening are oblong.

7. The headset of claim 1, wherein the membrane insert and the opening are rectangular.

8. The headset of claim 2, wherein due to the resilient material the membrane coupling is configured to produce a restoring force in response to relative movement in at least one of the six degrees of freedom between the outer housing and the end of the headband, wherein the relative movement is from a first position to a second position, and wherein the restoring force biases the relative movement back toward the first position.

9. The headset of claim 8, wherein the membrane coupling is configured to produce different magnitudes of restoring force in response to a same magnitude of translation for each of the three orthogonal degrees of translational freedom.

10. The headset of claim 9, wherein the different magnitudes of restoring force result from different thicknesses or hardness of different portions of the central portion.

11. The headset of claim 8, wherein the membrane coupling is configured to produce different magnitudes of restoring force in response to a same magnitude of rotation for each of the three orthogonal degrees of rotational freedom.

12. The headset of claim 11, wherein the different magnitudes of restoring force result from different thicknesses or hardness of different portions of the central portion.

13. The headset of claim 1, wherein the membrane coupling is configured to define different ranges of motion each of the three orthogonal degrees of translational freedom.

14. The headset of claim 13, wherein the different ranges of motion result from the central opening being located at non-uniform distances from each point of the perimeter of the central portion.

15. The headset of claim 1, wherein the membrane coupling is configured to define different ranges of motion each of the three orthogonal degrees of rotational freedom.

16. The headset of claim 15, wherein the different ranges of motion result from the central opening being located at non-uniform distances from each point of the perimeter of the central portion.

17. The headset of claim 1, wherein connection pin comprises a screw, and wherein a portion of the central portion around the opening is clamped between an end of the screw and the end of the headband.

18. The headset of claim 17, wherein the end of the headband comprises a ball coupled within a socket, and wherein the screw extends into and is directly coupled to the ball.

19. The headset of claim 1, further comprising:

a second earpiece comprising a second outer housing and a second audio driver positioned within and coupled to the second outer housing;

a second membrane insert composed of a resilient material, wherein the second membrane insert comprises a second central portion and a second flange around a perimeter of the second central portion, wherein the second central portion defines a second central opening and wherein the second flange is coupled to the second outer housing; and a second connection pin extending through the second central opening of the second membrane insert and into a second end of the headband, opposite the end of the headband, directly coupling the second end of the headband to the second membrane insert in order to couple the second outer housing to the second end of the headband, wherein the coupling of the second end of the headband to the second outer housing with the second membrane insert in between defines a second membrane coupling configured to allow relative movement in six degrees of freedom comprising three orthogonal degrees of translation freedom and three orthogonal degrees of rotational freedom.

20. A headset comprising:

an earpiece comprising an outer housing and an audio driver positioned within and coupled to the outer housing;

a membrane insert composed of a resilient material, wherein the membrane insert comprises a central portion and a flange around a perimeter of the central portion, wherein the central portion defines a central opening and wherein the flange is coupled to the outer housing;

a headband configured to be placed over a head of a user and exert a clamping force on the head of the user; and a connection pin extending through the central opening of the membrane insert and into an end of the headband directly coupling the end of the headband to the membrane insert in order to couple the outer housing to the end of the headband, wherein the coupling of the end of the headband to the outer housing with the membrane insert in between defines a membrane coupling configured to allow relative movement in six degrees of freedom comprising three orthogonal degrees of translation freedom and three orthogonal degrees of rotational freedom, wherein due to the resilient material the membrane coupling is configured to produce a restoring force in response to relative movement in at least one of the six degrees of freedom between the outer housing and the end of the headband, wherein the relative movement is from a first position to a second position, and wherein the restoring force biases the relative movement back toward the first position.

* * * * *